US009021615B2

(12) United States Patent
Cockram

(10) Patent No.: US 9,021,615 B2
(45) Date of Patent: May 5, 2015

(54) ACTIVEWEAR WITH WAISTBAND POCKET

(71) Applicant: Leigh Cockram, Collinsville, VA (US)

(72) Inventor: Leigh Cockram, Collinsville, VA (US)

(73) Assignee: Leigh Cockram, Collinsville, VA (US)

( * ) Notice: Subject to any disclaimer, the term of this patent is extended or adjusted under 35 U.S.C. 154(b) by 49 days.

(21) Appl. No.: 13/933,817

(22) Filed: Jul. 2, 2013

(65) Prior Publication Data

US 2015/0007379 A1 Jan. 8, 2015

(51) Int. Cl.
*A41D 1/06* (2006.01)
*A41D 27/20* (2006.01)

(52) U.S. Cl.
CPC . *A41D 1/06* (2013.01); *A41D 27/20* (2013.01)

(58) Field of Classification Search
CPC ..... A41D 1/06; A41D 27/20; A41D 27/204; A41D 27/24
USPC ..... 2/79, 227, 220, 236, 221, 237, 239, 2/247, 250, 253, 254
See application file for complete search history.

(56) References Cited

U.S. PATENT DOCUMENTS

| | | | | | |
|---|---|---|---|---|---|
| 1,196,324 | A | * | 8/1916 | Atkins | 2/211 |
| 1,478,497 | A | * | 12/1923 | Welch | 224/683 |
| 1,506,255 | A | * | 8/1924 | Rosenstein | 2/236 |
| 1,596,533 | A | * | 8/1926 | Haubenstock | 2/247 |
| 1,792,117 | A | * | 2/1931 | Paull | 2/253 |
| 1,920,061 | A | * | 7/1933 | Carr | 224/676 |
| 1,946,173 | A | * | 2/1934 | Miller et al. | 2/248 |
| 2,165,081 | A | * | 7/1939 | Wald | 2/247 |
| 2,197,584 | A | * | 4/1940 | Latter | 2/237 |
| 2,351,158 | A | * | 6/1944 | Stelzer | 224/199 |
| 2,359,012 | A | * | 9/1944 | Sophier | 2/247 |
| 2,489,148 | A | * | 11/1949 | Ludwig | 2/219 |
| 2,492,862 | A | * | 12/1949 | Harvey | 450/89 |
| 2,519,126 | A | * | 8/1950 | Falk | 2/247 |
| 2,537,701 | A | * | 1/1951 | Previdi | 2/94 |
| 2,544,840 | A | * | 3/1951 | Kowatsch | 2/67 |
| 2,551,907 | A | * | 5/1951 | Serebrin | 2/49.2 |
| 2,725,573 | A | * | 12/1955 | Kornhauser | 2/247 |
| 2,854,670 | A | * | 10/1958 | Naccash | 2/237 |
| 2,930,046 | A | * | 3/1960 | Sagner | 2/227 |
| 3,042,932 | A | * | 7/1962 | Eppy | 2/236 |

(Continued)

FOREIGN PATENT DOCUMENTS

| | | | |
|---|---|---|---|
| AU | 2012254915 | * | 6/2013 |
| WO | 9222463 | | 12/1992 |

*Primary Examiner* — Amy Vanatta
(74) *Attorney, Agent, or Firm* — New River Valley IP Law, PC; Mchele L. Mayberry

(57) ABSTRACT

Provided is activewear with hidden pockets. More particularly, athletic garments such as pants comprising one or more waistband pocket, preferably concealable, are included. In embodiments, athletic garments with an interior concealed pocket in the fold-over portion of a fold down waistband are provided. The waistband pocket enables the wearer to store items such as car keys, hotel room keys and/or smart phones relatively inconspicuously and securely in the waistband of the garment. A purpose of the concealment includes minimizing attention from the items stored within the pocket and allowing the wearer to participate in a variety of athletic sports or events while carrying personal items in a secure manner. Preferred embodiments include athletic pants comprising (i) a fold down waistband, (ii) an annular storage pocket capable of retaining items without any additional material added to the pant, and (iii) one or more slits for the opening for the pocket.

20 Claims, 26 Drawing Sheets

(56) References Cited

U.S. PATENT DOCUMENTS

| | | | | | |
|---|---|---|---|---|---|
| 3,137,862 | A | * | 6/1964 | Mizerak | 2/400 |
| 3,174,482 | A | * | 3/1965 | Parrott | 450/95 |
| 4,006,494 | A | * | 2/1977 | Knoppel | 2/227 |
| 4,079,871 | A | * | 3/1978 | Sica | 224/677 |
| 4,277,847 | A | * | 7/1981 | Florio | 2/12 |
| 4,428,080 | A | * | 1/1984 | Takamatsu | 2/227 |
| 4,464,798 | A | * | 8/1984 | Livingstone | 2/247 |
| 4,498,200 | A | * | 2/1985 | Livingstone | 2/247 |
| 4,523,703 | A | * | 6/1985 | McKenna | 224/676 |
| D283,077 | S | * | 3/1986 | Crandall | D2/738 |
| 4,601,418 | A | | 7/1986 | Gruzensky | |
| 4,620,326 | A | * | 11/1986 | Matthias, Jr. | 2/221 |
| 4,633,527 | A | * | 1/1987 | Ehring | 2/22 |
| 4,634,031 | A | * | 1/1987 | Frankhouse | 224/602 |
| 4,688,271 | A | * | 8/1987 | Capelle | 2/220 |
| 4,852,188 | A | | 8/1989 | Marsh et al. | |
| 4,888,006 | A | * | 12/1989 | Beaupied | 604/345 |
| 4,976,653 | A | * | 12/1990 | White | 450/155 |
| 5,050,244 | A | * | 9/1991 | Kleinman | 2/227 |
| 5,255,392 | A | * | 10/1993 | Stanislaw | 2/247 |
| D341,470 | S | * | 11/1993 | Quick | D2/713 |
| 5,425,719 | A | * | 6/1995 | Lessing, Jr. | 604/179 |
| 5,452,476 | A | * | 9/1995 | Jenks | 2/46 |
| 5,460,188 | A | * | 10/1995 | Barrett, Sr. | 128/842 |
| 5,544,366 | A | * | 8/1996 | Kato | 2/237 |
| 5,561,865 | A | * | 10/1996 | Fjelstul | 2/227 |
| 5,671,481 | A | * | 9/1997 | Giard | 2/170 |
| 5,792,714 | A | * | 8/1998 | Schindler et al. | 442/194 |
| 5,836,019 | A | | 11/1998 | Mccafferty | |
| 5,870,777 | A | * | 2/1999 | Hans | 2/238 |
| 5,878,441 | A | * | 3/1999 | Busker et al. | 2/247 |
| 5,956,765 | A | * | 9/1999 | Chin | 2/69 |
| 6,012,167 | A | * | 1/2000 | De Rosa et al. | 2/94 |
| 6,018,823 | A | * | 2/2000 | Ortmeier | 2/406 |
| 6,076,195 | A | * | 6/2000 | Klein | 2/400 |
| 6,134,713 | A | * | 10/2000 | De Rosa et al. | 2/94 |
| 6,138,282 | A | * | 10/2000 | Follese | 2/400 |
| 6,148,443 | A | * | 11/2000 | Maastricht | 2/69 |
| 6,308,340 | B1 | * | 10/2001 | Cook | 2/400 |
| 6,336,226 | B1 | * | 1/2002 | Garcia | 2/227 |
| 6,698,029 | B2 | * | 3/2004 | Tadros | 2/227 |
| 6,772,446 | B1 | * | 8/2004 | Black | 2/406 |
| D561,978 | S | * | 2/2008 | Soulides | D2/712 |
| 7,424,962 | B2 | | 9/2008 | Mooney | |
| D615,279 | S | * | 5/2010 | Savage | D2/731 |
| 7,735,155 | B2 | * | 6/2010 | Kerkhoff | 2/227 |
| 7,814,575 | B2 | * | 10/2010 | Hendrickson et al. | 2/227 |
| 7,900,276 | B2 | * | 3/2011 | Hendrickson et al. | 2/237 |
| 8,024,819 | B2 | * | 9/2011 | Gearhart | 2/238 |
| 8,028,345 | B2 | * | 10/2011 | Waite et al. | 2/69 |
| 8,272,073 | B2 | * | 9/2012 | Arensdorf et al. | 2/267 |
| 8,321,964 | B2 | * | 12/2012 | Gernes | 2/400 |
| 2004/0031830 | A1 | | 2/2004 | Davis | |
| 2004/0210987 | A1 | * | 10/2004 | Carney | 2/236 |
| 2005/0066424 | A1 | * | 3/2005 | Salazar | 2/227 |
| 2006/0218690 | A1 | | 10/2006 | James | |
| 2007/0157367 | A1 | * | 7/2007 | Kerkhoff | 2/227 |
| 2008/0115252 | A1 | * | 5/2008 | Dahan | 2/79 |
| 2008/0189832 | A1 | | 8/2008 | Oscher | |
| 2008/0301997 | A1 | * | 12/2008 | Tempini | 43/21.2 |
| 2009/0300818 | A1 | * | 12/2009 | Waite et al. | 2/76 |
| 2010/0281595 | A1 | * | 11/2010 | Gernes | 2/69 |
| 2013/0048687 | A1 | | 2/2013 | Do | |
| 2013/0276210 | A1 | * | 10/2013 | Clarke et al. | 2/220 |
| 2013/0305433 | A1 | * | 11/2013 | Hedrick | 2/220 |

* cited by examiner

ACTIVEWEAR WITH WAISTBAND POCKET

BACKGROUND OF THE INVENTION

1. Field of the Invention

The present invention relates generally to athletic outerwear or apparel, including in particular pant-type garments or pants, shorts, skirts, skorts, shirts, and generally any garment with a waistband. More particularly, in embodiments the present invention relates to activewear garments with an interior concealed storage pocket disposed in the waistband of the garment. The purpose of the concealment extends beyond minimizing attention to the items stored within the pocket by allowing the wearer to participate in a variety of athletic activities or events while carrying personal items in a safe and concealed manner. Preferred embodiments include activewear comprising (i) a fold down waistband, (ii) a space for a pocket that can hold items without any additional material added to the activewear and (iii) one or more slits for the opening of the pocket.

2. Description of Related Art

Men, women, and children participate more and more in recreational sporting activities and events such as running, tennis, golf, or biking, and in fitness activities and classes such as aerobics or yoga. When participating in these sporting activities there is often the dilemma of where to keep personal items, such as car keys, house keys, hotel keys, coins, cash, credit or debit cards, identification cards such as a driver's license, electronic devices, such as a phone, MP3 player, or tablet etc. Many times these items are placed in a pocket either in the legwear or in another item of clothing or a pack that is attached to the body at the arm, leg, wrist, or waist, such as a fanny pack. The items, as well as their conventional carrying means, typically create bulk, which is not desirable for freedom of movement during exercise. Because such packs can be cumbersome to the wearer and garments on the market typically do not have the capability to accommodate a wide range of items, oftentimes people who exercise will choose instead to leave doors unlocked instead of carrying their keys with them, or will leave their phones at home, which is not the best choice for personal safety.

Existing methods for securing these items include an additional pocket in the garment or in another item of clothing, or an expandable pouch or pocket that is somehow attached to the body such as the arm, leg, wrist, or waist. Several patents have attempted to address such methods for securing items. For example, U.S. Pat. No. 7,424,962 to Mooney, which is incorporated by reference herein in its entirety, describes a pocket strapped to the waist of one playing either golf or tennis. The pocket has a backing and front made of a fabric that is flexible and stretchable to hold golf or tennis balls and may be attached to a belt or may be worn in place of a belt. Similar devices exist for joggers, such as that disclosed in U.S. Pat. No. 4,601,418 to Gruzensky, which is incorporated by reference herein in its entirety, which describes a zippered pocket for money, keys, identification cards, and other personal items and which is constructed to be worn on the wrist or ankle.

There are items on the market for joggers that employ what is sometimes referred to as a pocket band. The band can go around the arm, the leg, the thigh, the waist, or the wrist of the wearer, such as that disclosed in U.S. Published Application No. 2004/0031830, which is incorporated by reference herein in its entirety. A zipper or Velcro (i.e., hook and loop type closure) closes the opening of the pocket band protecting the items inside from loss or theft. The adjustable pocket makes a portable compartment that eliminates the need to carry bulky purses, wallets, etc., and does not interfere with the freedom of movement of a jogger, however, the pocket band can interfere with the freedom of movement of the wearer while doing yoga or other activities that involve bending and other movements.

Similarly, a concealed pocket incorporated into the apparel is sometimes used for securing personal items while exercising. For example, U.S. Pat. No. 5,836,019 to McCafferty describes a sock with a hidden pocket, while U.S. Pat. No. 4,852,188 to Marsh describes a panty-type garment with a security pocket, which patents are both incorporated by reference herein in their entireties. There are also hidden pockets added to jackets, shirts, hosiery, and hoodies. Additionally, activewear for joggers often have pockets in the front or back that are closed with zippers. Such pockets are incorporated into the garments using additional material to form the pocket. It would be much more cost effective, however, to provide a pocket using the material of the garment itself without adding material for a pocket.

A "hipband pouch" is disclosed in U.S. Published Application No. 2013/0048687, which is hereby incorporated by reference herein in its entirety. The pouch is intended for use as an accessory and is worn in addition to a person's other exercise garments. The pouch comprises a tubular pocket with openings disposed laterally along a single circumferential seam such that the pocket openings are where the seam of the pouch is purposefully left open. Laterally spaced openings along the seam itself are prone to failure after repeated use in that the seam will tend to come apart at the point where the opening ends and the seam begins due to the opening being stretched to accommodate items. Much worse, the fabric may instead rip at this juncture requiring undesired repair of the garment. Additionally, such a pouch adds bulk to a user since it is worn in addition to the user's regular clothing and is not part of the activewear itself. Other disadvantages of such a pouch are that they tend to ride up on the user's torso and will typically not stay put where the user initially places the pouch, making its use uncomfortable or unaesthetic to the user or others.

From the above discussion it is apparent that what is desired is a pocket within the activewear that can hold personal items safely and securely, while not compromising the aesthetics and comfort in the design of the garment. A pocket such as this should provide convenient ergonomic access so the items may be retrieved during or after the sporting event with convenience. What is needed is activewear that fits, functions, and performs for the sport chosen, and yet looks and feels great while allowing for a place to safely keep personal items during participation in the sporting event. In other words, the activewear should be comfortable, and flattering, yet practical. It should also allow for the range of motion necessary for the sporting event. The activewear should function for the desired activity as well as have a pleasing appearance. The activewear should be durable and easy to wash while being constructed out of a minimal number of parts. The activewear should be cost effective, light weight, with a bulk-free waistband that allows a full range of movement of the wearer.

According to embodiments of the invention, a pocket within the waistband of the actual garment is capable of accomplishing one or more of these criteria and can be incorporated for example into shirts, skirts, shorts, skorts, and pants. In embodiments, the waistband goes all the way around the waist, and provides for comfort and flexibility in range of motion, while also providing a pocket space within the waistband. Access to the pocket within the actual waistband itself can be provided by slits or cuts in the fabric that are finished around the opening to provide for a strong and wear-resistant opening. Preferred embodiments include a foldable waistband with additional material to fold over and conceal the openings.

SUMMARY OF THE INVENTION

The numerous limitations inherent in conventional activewear with hidden pockets or pouches described above provide great incentive for a new, better form of activewear with a concealed pocket and which is capable of accounting for one or more of these issues. The present invention relates generally to athletic outerwear/apparel and particularly to athletic wear for the lower body, such as pants, shorts, capris, skirts, and skorts. More particularly, the present invention relates to athletic garments with a concealed storage pocket incorporated into the waistband of the garment. Preferred embodiments of the invention provide for a fold-over waistband that for example can be folded down to conceal the pocket openings or can be folded up to reveal the pocket openings.

In embodiments of the invention, the pocket can be formed by a first layer of material that provides for an exterior facing surface of the waistband and a second layer of material that provides for an interior facing surface of the waistband. The layers of material can be a single sheet of material folded over and sewn together with the lower portion of the garment. This provides for an annular pocket that traverses the entire waist when worn. In embodiments, the pocket can be configured as a single pocket encircling the waist, or can be portioned into two or more smaller regions covering from 0-360° around the waistband by incorporating one or more horizontal seams into the waistband. One or more openings to the pocket are provided by cuts or slits in the fabric. The slits can be disposed in the outwardly facing layer of material or in the layer of material intended to face or contact the user's body. In embodiments, the pocket does not have a closure, but could be closed, such as by a zipper, or Velcro or snaps or buttons, etc. Although not necessary, and in preferred embodiments, the openings to the pocket can be finished by a hem line, and/or by surging, and/or by ribbon sewn over the unfinished edge, and/or by using bias tape. Such a finished opening provides for a stronger pocket opening and leads to longevity of the garment. The items in the pocket, in embodiments, are held in place by the elasticity of the material the activewear is made from, and/or by the vertical or horizontal slit, which is smaller than the items placed within the pocket, but which expands to allow for the items to be placed within the pocket.

Specific embodiments of the invention can include activewear, such as pants, comprising: (i) a body portion with two pant legs and a top edge defining a waistline; (ii) a waistband comprising a single sheet of material in a folded configuration; (iii) wherein the body portion and the waistband are in direct communication with one another by a seam along the waistline; (iv) wherein the waistband, when joined with the body portion, provides a pocket capable of holding items; and (v) wherein the waistband comprises one or more cuts in the material to provide access to the pocket as one or more pocket openings.

Alternatively or in addition, the activewear can be configured such that the pocket is annular and extends 360° around the waistband.

In embodiments, alternatively or in addition, the activewear can be configured such that the waistband has a width of between approximately 1 and 8 inches wide.

The activewear can be alternatively or in addition configured such that the one or more pocket openings have a dimension of about 10-100% of the width of the waistband. For example, the activewear can be configured such that the one or more pocket openings have a dimension of about 25-50% of the width of the waistband.

Alternatively or in addition, the activewear can be configured such that the waistband comprises a horizontal seam encircling the waistband 360° and dividing the waistband in half into two annular regions, wherein an upper annular region is capable of being folded over a lower annular region comprising the pocket and the pocket openings.

In yet further embodiments, alternatively or in addition, the activewear can be configured such that the waistband comprises two or more vertical seams for dividing the lower annular region into smaller segments.

Further for example, activewear embodiments can alternatively or in addition comprise two vertical seams to divide the lower annular region into a front pocket and a back pocket, wherein each of the front and the back pocket extend 180° degrees around the waistband. Even further, for example, such activewear can be configured such that multiple vertical seams provide pockets at one or more various locations around the waistband.

Preferred are activewear embodiments such as pants wherein the waistband is configured to provide a fold-over portion for covering the pocket openings.

The activewear can be configured such that one or more of the pocket openings are disposed on a side of the waistband contacting the wearer. Alternatively or in addition, the activewear can be configured such that one or more pocket openings have no closure and are finished around a pocket opening edges by one or more of a hem line, surging, ribbon sewn over the edge, or bias tape sewn over the edge. Alternatively or in addition the activewear can be configured such that one or more pocket openings have a closure chosen from a zipper, hook and loop type closure, hooks, buttons, or snaps.

In embodiments, the activewear can be configured such that items disposed in the pocket are held in place by one or more of fabric elasticity or pocket opening size.

The body portion of the activewear according to any embodiment herein can be an athletic pant style chosen from running pants, capri pants, tight shorts, or loose shorts.

Preferably, such activewear pants comprise a body portion comprising a leg portion configured as straight, boot cut, loose, or form fitting.

The activewear according to embodiments of the invention can comprise a waistband made from one or more of jersey, knit, cotton, nylon, spandex, rayon, polyester, or combinations thereof. Preferably, the activewear pants comprise a waistband made from about 80-90% nylon and from about 10-20% spandex.

Methods of making activewear of the invention are also included. Any method for making any of the embodiments described in this specification can be used. Preferred is a method of forming activewear pants said method comprising: (i) forming a waistband from an elongated sheet of material by: (a) joining opposing ends of the material to form a ring-like structure; and (b) folding the ring-like structure to align opposing edges of the material; (ii) providing a body portion comprising two apertures for legs of a user and having a top edge that defines a waistline; and (iii) joining the waistband to the body portion along the waistline to provide for an annular pocket in the waistband.

A waistband for any garment wherein the waistband comprises a concealed pocket is also included within the scope of the invention. In particular, a waistband comprising: (i) an annular pocket defined by a front and back layer of material forming a waistband; (ii) one or more cuts in the front or back layer of material to provide pocket openings; and (iii) a portion of the waistband capable of being folded to conceal the pocket openings is preferred.

DETAILED DESCRIPTION OF PREFERRED EMBODIMENTS

Figure 1A:
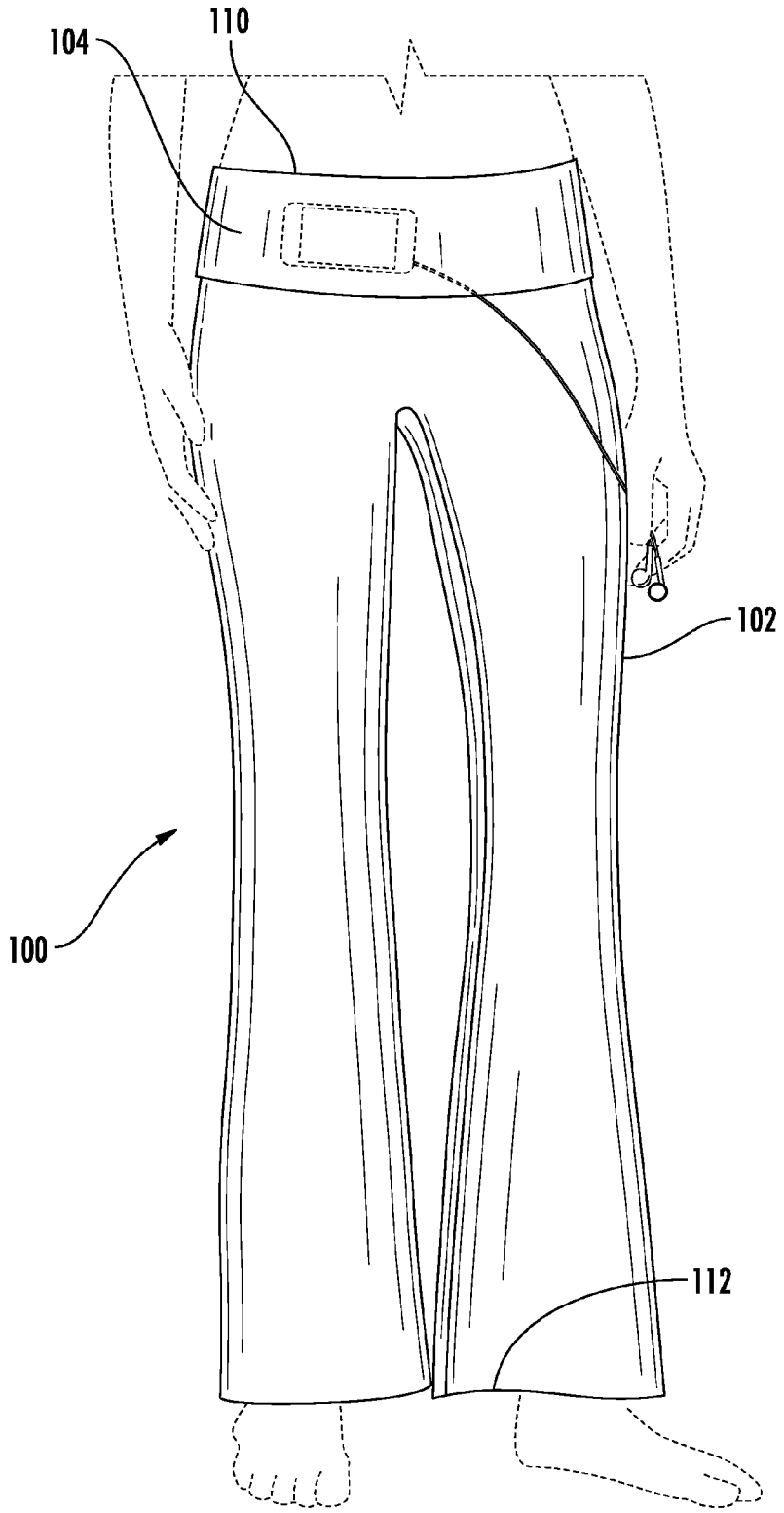
FIGS. 1A-D are schematic drawings showing various BOOT CUT type activewear embodiments according to the invention with a fold-over, annular waistband pocket, where the waistband is folded down to conceal pocket opening(s) (FIG. 1A); the waistband is unfolded to reveal a right-side vertical pocket opening (FIG. 1B); the waistband is folded up to reveal a left-side horizontal pocket opening (FIG. 1C); and the waistband is folded up to reveal vertical pocket openings on the left and right sides of the pant (FIG. 1D).

Reference will now be made in detail to various exemplary embodiments of the invention. Embodiments described in the description and shown in the figures are illustrative only and are not intended to limit the scope of the invention, and changes may be made in the specific embodiments described in this specification and accompanying drawings that a person of ordinary skill in the art will recognize are within the scope and spirit of the invention.

The present invention relates generally to athletic apparel and more particularly to activewear pants, shorts, skirts, skorts, shirts, and so on. Generally, any garment with a waistband can be adapted to incorporate one or more features of the waistband pocket of the present invention. More particularly, the present invention relates to activewear garments with a waistband pocket. In preferred embodiments, provided is a concealed storage pocket incorporated into a fold-over type waistband.

An object of the present invention is to provide activewear that is easy to manufacture, can be mass produced, and is less expensive to make due to constructing the apparel from a minimum number of parts and using less material than other garments may use to provide pockets. Another object of the present invention is to provide new and improved activewear that incorporates a concealed pocket of simple construction within the garment. Another object of the present invention is to provide new and improved activewear with a pocket for hands-free secure carrying of personal items while the wearer participates in athletic events or exercise activities. Another object of the present invention is to provide new and improved activewear with a concealed pocket that an individual can easily access while also providing securement of articles therein. Yet another object of the present invention is to provide a concealed pocket in activewear such that an item stored in the concealed pocket would be relatively undetectable. Embodiments of activewear according to the invention can comprise a wide variety of styles and lengths useful for different athletic activities.

Preferred embodiments of the invention include activewear comprising: (i) a fold down waistband, (ii) where the waistband functions as a pocket capable of retaining items, and (iii) one or more pocket opening. In especially preferred embodiments, the pocket is the waistband itself and no additional material is used to provide or create the pocket.

In various embodiments, the pocket opening is by a slit. The opening is preferably formed by cutting the fabric of the waistband. The slit or cut type opening can be punched, cut, torn, or by similar means, into the garment at any point during the manufacturing process, such as prior to, during, or after joining the waistband with the remainder of the garment. For example, the material for the waistband can be laid out as a single sheet of fabric, then the openings for the pocket introduced into the material at one or more desired locations on the waistband, then the sheet of fabric can be folded into the desired waistband shape and sewn together at one end to provide an annular form that is then joined to the remainder of the pant. One or more additional seams can be introduced to the waistband portion of the pant, for example, to divide the 360° annular pocket region into two or more smaller segments. In especially preferred embodiments, there are two perpendicular side seams to divide the annular region into a front pocket extending 180° around the waistband and a back pocket extending the remaining 180° around the waistband. Each of the front and back pockets can have their own pocket opening for access to the pocket.

In various embodiments, the one or more pocket slits and the one or more pockets can be any number, for example, ranging from 1-20, such as 1, 2, 3, 4, 5, 6, 7, 8, 9, 10, 11, 12, 13, 14, 15, 16, 17, 18, 19, or 20. The slits and pocket seams, if present, can be disposed at any desired angular location from 0-360° around the waistband. Likewise, the slit type openings can be disposed at any location along the width of the waistband. The slit(s) can be oriented in any direction from vertical to horizontal relative to an edge of the waistband and in between, such as horizontal (parallel with an edge of the waistband), or 5°, 10°, 15°, 20°, 25°, 30°, 35°, 40°, 45°, 50°, 55°, 60°, 65°, 70°, 75°, 80°, 85° above the horizontal, such as at about 90° (i.e., perpendicular to an edge of the waistband) above horizontal.

In various embodiments, the height of the waistband may be any height and for example can vary from approximately 1 inch to 8 inches. The height/width of the waistband and the height/width of the pocket slit in various embodiments may be of any height and can for example vary from approximately 1 inch to 8 inches. Any height/width waistband and any height/width pocket slit can be used including for example, 0.5 inches, 1 inch, 2 inch, 3 inches, 4 inches, 5 inches, 6 inches, 7 inches, or 8 inches, or even ½ or ¼ inches between these numbers. The length of the pocket slit can be any length as well, such as from between 0% and 100% of the length of the waistband, including from 5%, 10%, 15%, 20%, 25%, 30%, 35%, 40%, 45%, 50%, 55%, 60%, 65%, 70%, 75%, 80%, 85%, 90%, or 95% of the length of the waistband. In embodiments, the pocket opening can be vertical, running half the height/width of the waistband, for instance a slit height of about 1 inch in a 2 inch high/wide waistband, or about 1.5 inches in a 3 inch high/wide waistband, or about 2 inches in a 4 inch high/wide waistband, or about 2.5 inches in a 5 inch high/wide waistband, or about 3 inches in a 6 inch high/wide waistband. The slit can be horizontal with the same length ratio scheme, or multiple slits can be used to access the pocket with a combination of vertical and horizontal slits.

In various embodiments, the waistband may fold-over and still be intended to fit on the wearer's waistline typically somewhere between the top of the person's hipbone and their navel. In other embodiments, the waistband is a non-fold-over waistband, meaning if it were folded over in its entirety it would fall outside this region. In various embodiments, the waistband has no seams segregating the waistband into smaller regions. The waistband, however, could have a seam that would create a smaller space for the pocket, such as a horizontal seam encircling the waistband and dividing the fold over waistband in half into two annular regions, an upper annular region that can be folded over the lower annular region; or such as one or more vertical side seam for dividing the annular region in half to provide one pocket in the front and one pocket in the back and where each pocket extends 180° around the waistband; or such as multiple vertical side seams to provide pockets at one or more various locations around the waistband extending from 0-180° around the waistband.

In various embodiments, the pocket slit does not include a closure. Optionally, the pocket slit can include any type of closure such as Velcro, a zipper, hooks, buttons, snaps, hook and loop, laces, or a similar mechanism.

In various embodiments, the items are held in place in the pocket by the elasticity of the material or may be held in place by the size of the slit, which is smaller than the item but which can be stretched to accommodate the item. The pocket slit can run in any suitable direction and distance, on either the front or back side of the activewear.

In various embodiments, the activewear can be athletic pants, running pants, capris pants, tight shorts, loose shorts, a skirt, a skort, or even a shirt. Indeed, any article of clothing that has a waistband can incorporate objects of the invention. In various embodiments the leg of the pant can be straight, boot cut, tight, or loose.

Activewear embodiments of the invention may be made of any desirable material and/or combination of materials. The waistband may be made from the same and/or different material as the remainder of the garment. In some embodiments the material may be breathable, sweat absorbing, water resistant, elastic, ultra comfortable, and/or performance-driven. An elastic type material may enhance the fit around the body of the wearer, thereby improving the comfort and/or enhancing the concealment of the items in the pocket. In some embodiments the material may be jersey, fleece, terry cloth, knit fabric, cotton, organic cotton, modal, viscose, PILAYO, heathered PILAYO, nylon, spandex, polyester, or rayon, or a blend of any of the materials. The knit fabric may be any knit fabric known in the art such as double knit, single knit, baby rib knit, interlock knit, or textured novelty knit.

Examples of blends that various embodiments may be made from include polyester/rayon/spandex blends, such as 47% polyester, 47% rayon, and 6% spandex; or from 30-60% polyester, 30-60% rayon, and 1-20% spandex; such as from 40-50% polyester, 40-50% rayon, and 2-18% spandex, such as from 43-49% polyester, 43-49% rayon, and 3-15% spandex; such as from 45-52% polyester, 45-52% rayon, and 4-10% spandex; including from 35-50% polyester, 40-50% rayon, and 5-8% spandex, and so on. Likewise, a blend of 88% nylon and 12% spandex is also preferred, or 90:10 nylon: spandex, or anywhere from 70-98% nylon and 2-30% spandex could be used.

In embodiments, the fabric blend can comprise from 1-6 types of materials, such as from 1, 2, 3, 4, 5, or 6 types of materials. These materials can be present in any amount, including for example where the blend is 50:50, or 45:55, or 40:60 or 35:65, or 30:70, or 25:75, or 20:80, or 15:85, or 10:90, or 5:95, or each component is present from about 1-99%, such as from 2-95%, or from about 3-98%, or from 4-97%, or 5-90%, or 6-92%, or 7-91%, or 8-96%, or 9-94%, or 10-93%, or 11-89%, or 12-88%, or 13-87%, or 14-86%, or 15-85%, or 16-84%, or 17-83%, or 18-82%, or 19-81%, or 20-80%, or 21-79%, or 22-78%, or 23-77%, or 24-76%, or 25-75%, or 26-74%, or 27-73%, or 28-72%, or 29-71%, or 30-70%, or 31-69%, or 32-68%, or 33-67%, or 34-66%, or 35-65%, or 36-64%, or 37-63%, or 38-62%, or 39-61%, or 40-60%, or 41-59%, or 42-58%, or 43-57%, or 44-56%, or 45-55%, or 46-54%, or 47-53%, or 48-52%, or 49-51%, or 50% each.

Particular examples of blends can include 97% cotton with 3% spandex, or from about 80-99% cotton with about 1-20% spandex, such as a 99:1, or 98:2, or 97:3, or 96:4, or 95:5, or 94:6, or 93:7, or 92:8, or 91:9, or 90:10, or 89:11, or 88:12, or 87:13, or 86:14, or 85:15, or 84:16, or 83:17, or 82:18, or 81:19, or 80:20, or 79:21, or 78:22, or 77:23, or 76:24, or 75:25, or 74:26, or 73:27, or 72:28, or 71:29, or 70:30 cotton: spandex blend, or cotton:polyester blend, or polyester/spandex blend. These materials can be used for one or more of the waistband, the legs of the garment, and/or the crotch or other parts of the garment, with any one or more of these parts of the garment being the same or different. Preferred materials and blends can include one or more of organic cotton/spandex, cotton/modal, viscose/spandex, PILAYO (SUPPLEX Nylon/LYCRA Spandex), Heathered PILAYO (SUPPLEX Nylon/Polyester/LYCRA Spandex), or COOLMAX (polyester). The lists of materials and compositions of the fabric provided in this specification are not meant to be exhaustive but only representative of the types of materials and amounts of material that could be used.

Figure 1B:
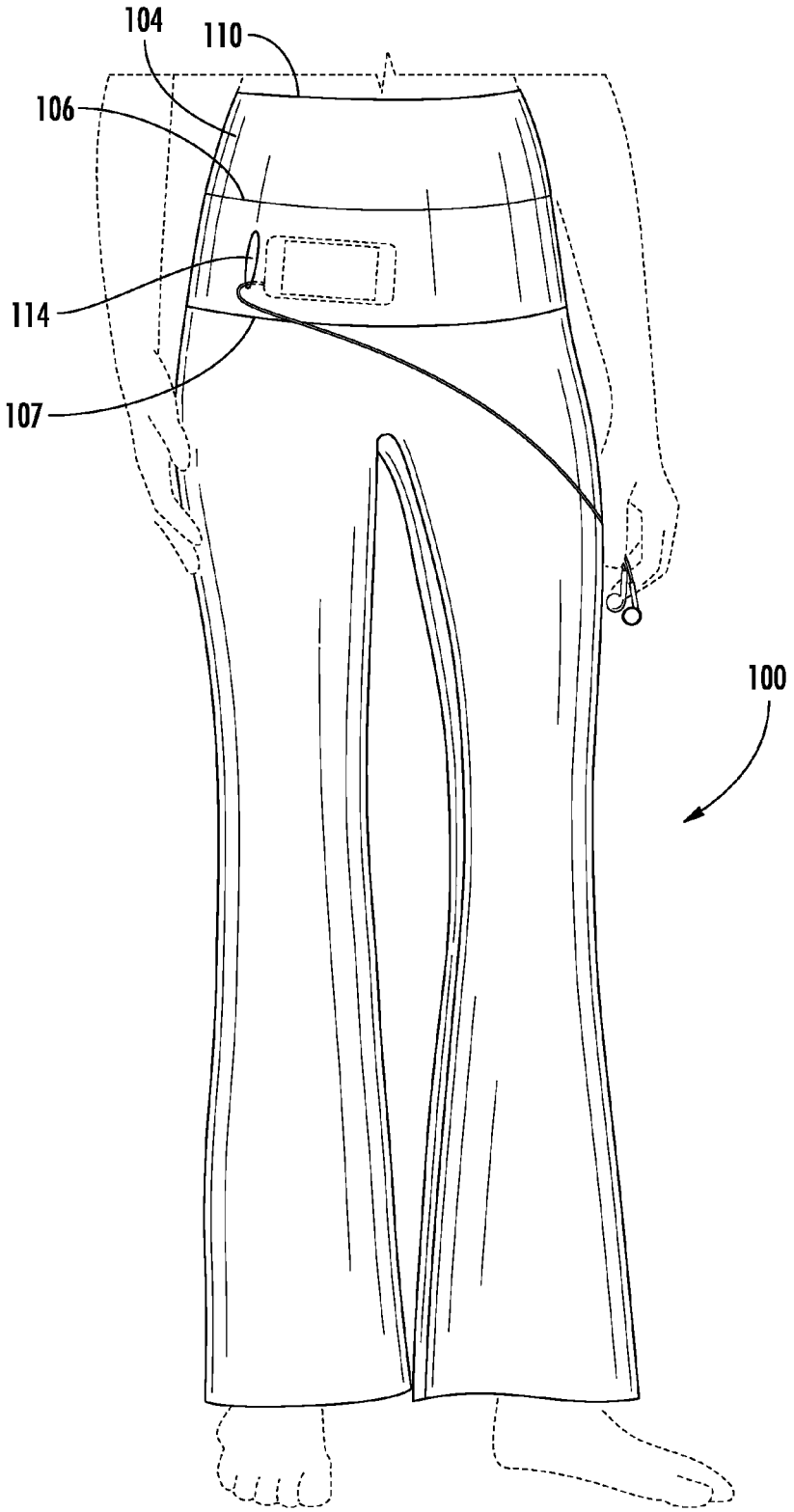
Figure 1C:
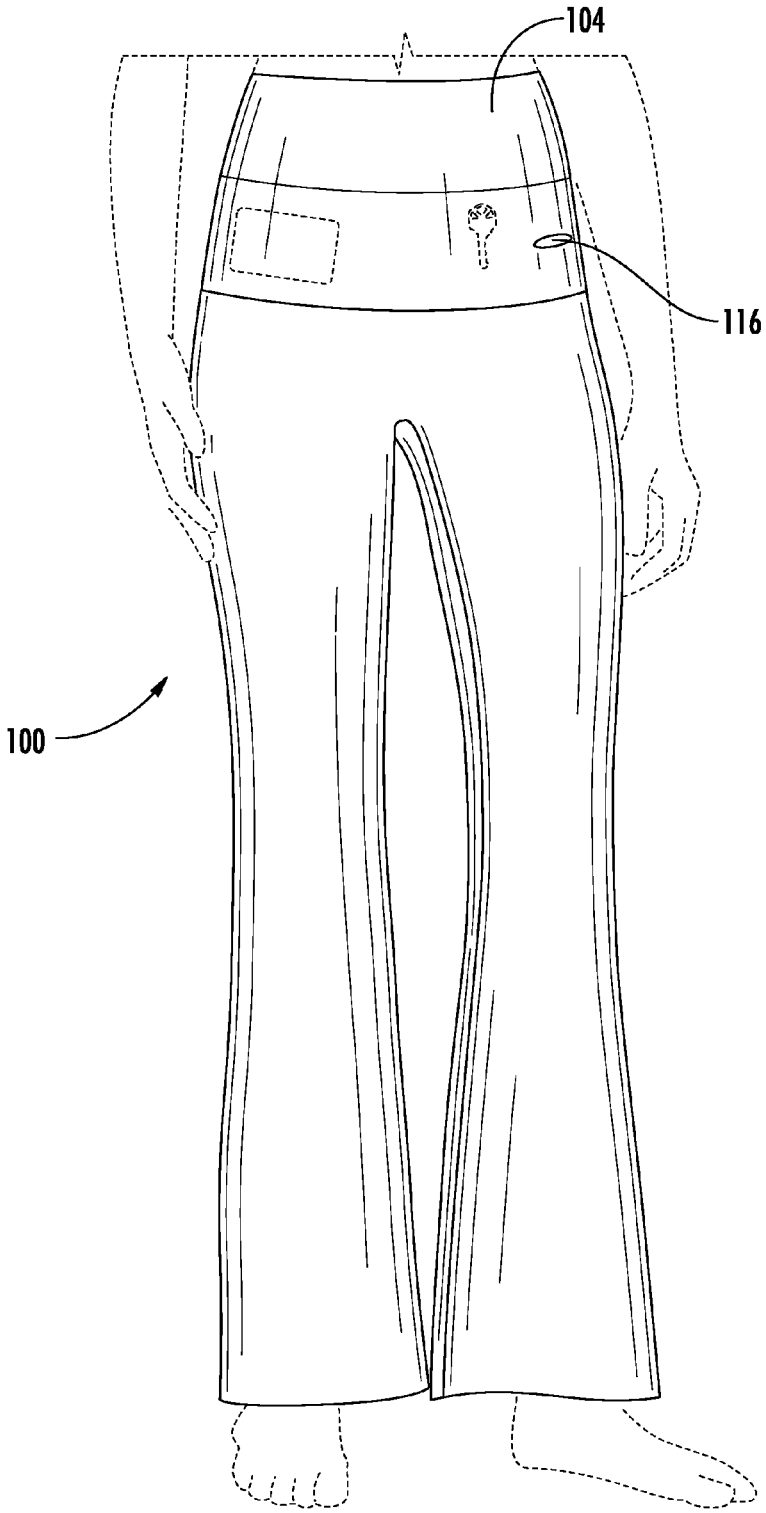
Figure 1D:
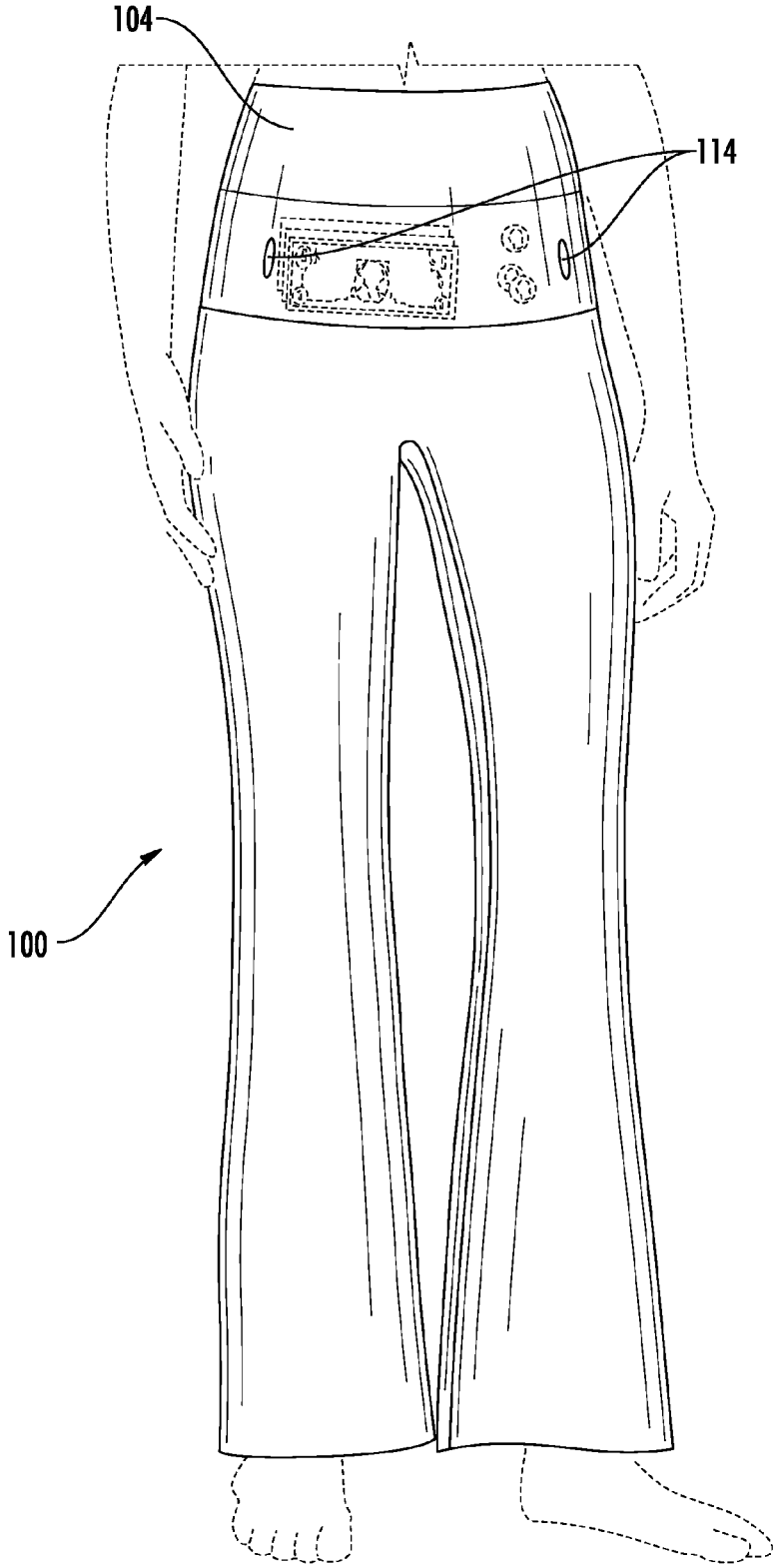
Figure 1E:
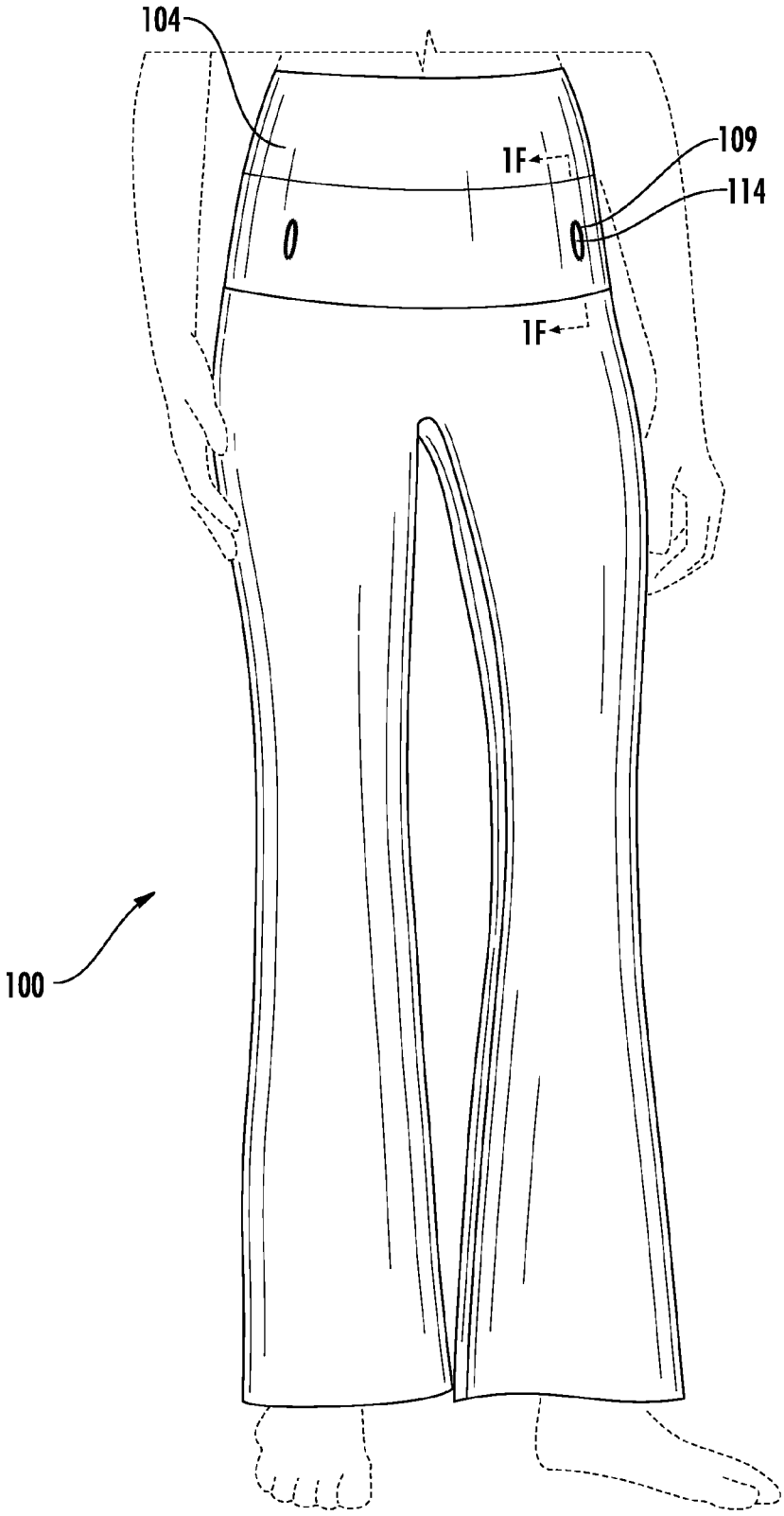
FIGS. 1E-F are schematic diagrams showing BOOT CUT type activewear of the invention with an unfolded, annular waistband pocket where the pocket is about half the width of the waistband and comprises left and right vertical pocket openings (FIG. 1E); and a cross-sectional view of the waistband pocket of FIG. 1E along the pocket opening (FIG. 1F).
Figure 1F:
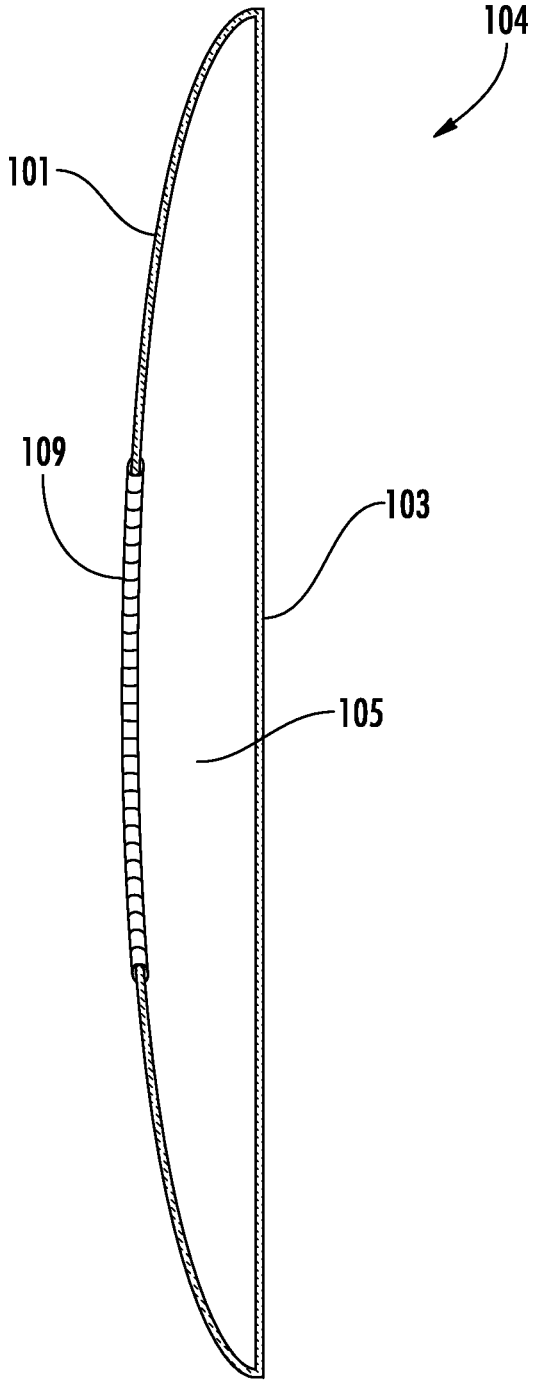

Referring now to the figures, more particular embodiments will be described as illustrated in FIGS. 1A-F, which are schematic drawings illustrating various waistband pocket embodiments with variations for example on configurations for the pocket slit. FIGS. 1A-D are schematic drawings showing various BOOT CUT type activewear embodiments according to the invention with a fold-over, annular waistband pocket, where the waistband is folded down to conceal pocket opening(s) (FIG. 1A); the waistband is unfolded (or folded up) to reveal a right-side vertical pocket opening (FIG. 1B); the waistband is folded up to reveal a left-side horizontal pocket opening (FIG. 1C); and the waistband is folded up to reveal vertical pocket openings on the left and right sides of the pant (FIG. 1D). FIGS. 1E-F are schematic diagrams showing BOOT CUT type activewear of the invention with an unfolded, annular waistband pocket where the pocket is about half the width of the waistband and comprises left and right vertical pocket openings (FIG. 1E); and a cross-sectional view of the waistband pocket of FIG. 1E along the pocket opening (FIG. 1F).

More particularly, FIG. 1A is a representative diagram of an embodiment of the activewear garment of the present invention shown in BOOT CUT style with a 6 inch waistband folded down to hide the pocket opening of the annular waistband pocket. The waistband pocket in this embodiment is 3 inches in height, which is half the height of the entire waistband. As illustrated, a portable media player, such as an IPOD, is concealed and secured within the annular waistband pocket by the 3 inch fold-over portion of the waistband.

As shown in FIG. 1A, there is provided an activewear garment 100 according to aspects described herein. The activewear garment 100 includes a body portion, shown generally as 102, and a waistband 104. Each portion of the activewear garment may be formed from a textile element as is discussed in greater detail at other portions of this specification. The body portion 102 and the waistband 104 may be joined by any known method of joining multiple textile elements, such as stitching, adhesives, and the like. The body portion 102 generally includes a main portion configured to fit around the midsection of the wearer, including the abdomen and the gluteal areas, and two leg portions that extend from the main portion through which a wearer's legs may extend. In alternate embodiments, the leg portions may be longer or shorter than the leg portions shown in FIG. 1A, or may be of a tighter or looser fit on the wearer. In embodiments, the textile element of the waistband 104, the main portion of the body 102, and the leg portions may comprise the same or different materials and/or the same or different compositions of materials. The body portion 102 may be formed of any suitable material to provide comfort to the wearer. In some embodiments the body portion 102 may be formed from jersey, knit fabric, cotton, nylon, spandex, polyester, organic cotton, viscose, or a blend of any of the materials, such as a polyester/rayon/spandex blend. Any of the types of materials and/or compositions of materials provided in this specification may be used for any embodiment of garment described herein.

The body portion 102 includes a plurality of apertures 110, 112. A first, torso aperture 110 is arranged at a top of the body portion 102 and is sized to accommodate the torso of the wearer. This torso aperture 110 may be sized to fit a variety of persons and is preferably shaped and sized to fit around the waistline of a wearer, such as between the top of the hipbone and the navel of the user or higher on the torso. In addition, the body portion 102 of the activewear garment 100 may include an elastic element such that the garment 100 may stretch to fit a variety of wearers. The waistband 104, and/or the body portion 102, may be formed of an elastic-type material, allowing the torso aperture 110, or the garment 100, to stretch, as needed to accommodate larger users or to provide for a more desired form fitting appearance when worn by the wearer. Two leg apertures 112 are generally included in body portion 102. The leg apertures 112 may vary from straight, boot cut, tight, or loose.

As shown in FIG. 1A, the waistband 104 comprises a hidden pocket that may contain items of the wearer for safe keeping. Access to the pocket is provided by an opening to the pocket that is hidden by an upper portion of waistband 104 when that portion of the waistband is folded down. Because of this novel construction the waistband 104 can be readily folded down over itself or the remainder of the body portion 102 of the activewear. As illustrated, the pocket opening can provide a way for wearers of the garment to enjoy music or other media by allowing for the wires of earbuds to protrude from the pocket while a portable media player, such as an IPOD, is retained safely and securely within the pocket. The fold-over portion of waistband 104 provides an additional level of security to retaining items and concealing the items within the hidden pocket.

FIG. 1B shows the same style pant as illustrated in FIG. 1A with the fold-over waistband 104 in an unfolded position (or folded up) to reveal a pocket opening 114 to the waistband pocket. The height of the pocket opening 114 (here, vertically disposed) or slit in this embodiment is about one-half to one-third the height of the pocket, or from about 1-1.5 inches in height. As shown, the fold-over waistband 104 can comprise multiple regions, such as two regions. In this embodiment, provided is an upper waistband portion terminating at an upper waistband edge along which is disposed the torso aperture 110 and a lower waistband portion terminating at a seam 107 between the waistband 104 and the body 102. These regions are divided by seam 106 that runs between and parallel with torso aperture 110 at the upper edge of the waistband and seam 107 at the lower edge of the waistband. The seam 106 is optional and additional seams can be included, whether parallel or perpendicular to seam 106, to further divide the waistband into several smaller regions and/or pockets. Here, the pocket region is in the lower portion of waistband 104 and extends 360° around the waistband of the garment and is about half the height of the waistband, or about 3 inches wide.

FIG. 1C shows the same style pant as illustrated in FIGS. 1A-B with a 1.5 inch horizontal pocket slit 116 on the left side of the waistband 104 of the pant rather than on the right side, as is shown in FIG. 1B. Although shown unfolded in this embodiment, waistband 104 may be in a folded down position so as to hide the horizontal pocket slit 116 or may be in an extended position to expose the pocket slit, as shown. The wearer of the garment 100 can use the pocket to stow away personal items, such as lipstick or other make up, house or car keys, hotel keys or credit cards, money, mobile phones, portable media players, radios, mace, and so on. As shown in FIG. 1C the waistband pocket is useful for securing keys and credit cards. A benefit of the waistband pocket of the invention is that the pocket is capable of accommodating multiple different items in a safe and secure manner. For example, existing garments have pockets configured for holding just a phone or just a key and are shaped and sized for retaining that item in particular. When the user puts a key in a pocket intended for a phone, the key can be dislodged and lost. Similarly, a user with a garment with a pocket for holding a key will not be able to stretch the pocket opening and/or the pocket itself enough to accommodate a phone. In contrast, the waistband pocket of the invention is configured to retain any number of different items. In this embodiment items such as keys and credit cards can be inserted into the opening 116 and positioned at any position around the waistband 104. Here, the credit card is positioned at the right front of the garment, while the key is positioned at the left front of the garment and closer to opening 116. Likewise, because the pocket in this configuration extends 360° around the waistband 104, the items can be pushed into the opening 116 and then maneuvered around to the back side of the garment to conceal the items along the backside of the wearer.

Alternatively, multiple pocket openings can be provided in the front and/or back of the waistband of the garment. As shown in FIG. 1D, which shows the same style pant as illustrated in FIGS. 1A-C, the garment 100 can comprise a plurality of pocket slits 114, 116 disposed at various positions along the waistband 104 of the garment 100. In this embodiment, two pocket openings, 1 inch vertical pocket slits 114, are disposed on the left and right sides of the waistband 104. Such a configuration may provide for easier insertion and retrieval of multiple items stored in the waistband 104. Similar to other embodiments, although shown unfolded in this embodiment, waistband 104 may be in a folded down position so as to hide the vertical pocket slits 114 or may be in an extended position to expose the pocket slit, as shown. As shown in FIG. 1D, the pocket of the waistband can be used to stow away paper money on one side of the waistband and coins on the opposing side.

FIG. 1E provides more detail about various configurations of the pocket and pocket opening for garment 100. Multiple pocket slits can be provided to access the pocket of the waistband. As shown in FIG. 1E, two vertical pocket openings 114 can be provided in the waistband 104, where one or more or all of pocket openings 114 have a finished edge 109. Depending on the type of fabric used, a finished edge may be desired to prevent fraying of the fabric after repeated use and/or washing. The openings 114 to the pocket can be finished by a hem line, and/or by surging, and/or by ribbon sewn over the unfinished edge, and/or by using bias tape. A finished opening provides for a stronger pocket opening and leads to longevity of the garment. In this embodiment, the finished edge 109 is provided by sewing around the edge to fortify the edge with additional thread or in a similar manner to providing for button holes. In preferred embodiments, the edge is finished in a manner that provides for the opening to be stretched to accommodate items larger than the opening. In this manner, such larger items can be inserted into the waistband pocket and retained there without falling back through the opening since the opening is smaller than the object. The items are alternatively or in addition retained in the waistband pocket due to the type of material used in waistband 104, such as a polyester/rayon/spandex blend or similar fabric supplying the desired amount of elasticity to constrict an item once placed in the pocket. Additionally or alternatively, a fold-over waistband can be incorporated into the pant, as shown in FIG. 1E, to provide additional securement of items within the pocket.

FIG. 1F provides additional detail about the pocket of waistband 104. More particularly, a cross-sectional view of the pocket is provided, which shows a cross section of the annular region defined by the pocket. As illustrated, pocket 105 can be formed from a single sheet of material folded over to provide for space between the folded sheet. The folded sheet comprises a front layer of material 101 and a back layer of material 103. When a garment containing the waistband pocket 105 is worn by a wearer in a typical manner, the back layer of material 103 is in contact with the waist of the wearer, while the front layer of material 101 will face outward and be seen by others. The finished opening 109 to the pocket 105 can be incorporated into the fabric at any point but is preferably introduced prior to partial formation of the waistband, or prior to complete formation of the waistband. For example, the finished openings 109 can be added to the sheet of fabric in a similar manner to button holes. Then the material can be joined at the elongated ends of the fabric to provide the sheet of fabric as a ring of material. The ring-like sheet of material can then be folded over on itself and sewn around the bottom elongated edges of the front 101 and back 103 layers to join the material and create an annular or tubular region between layers 101, 103. Alternatively or in addition, once the sheet of material is folded over, the sheet of material can be joined with the body portion of the garment along the elongated edge of the body portion as well. Sewing or joining these edges (the body portion edge, the front layer 101 edge, and the back layer 103 edge) together simultaneously may save on manufacturing steps and costs.

Figure 2A:
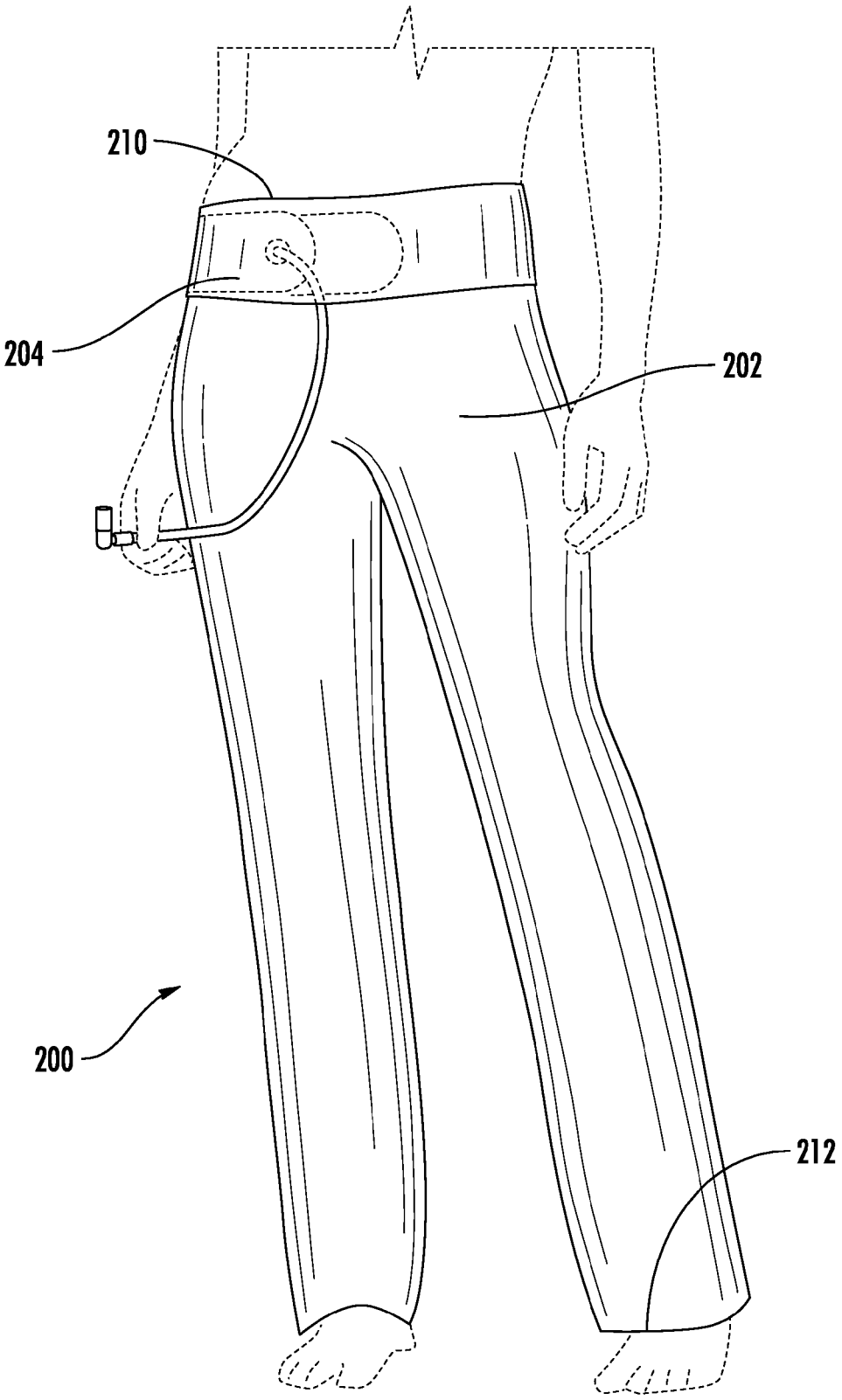
FIGS. 2A-B are schematic diagrams illustrating a STRAIGHT LEG type pant of the invention comprising a waistband with an annular pocket, where the waistband is folded over to conceal the pocket opening (FIG. 2A); and where the waistband is unfolded to reveal a right-side vertical slit pocket opening (FIG. 2B).
Figure 2B:
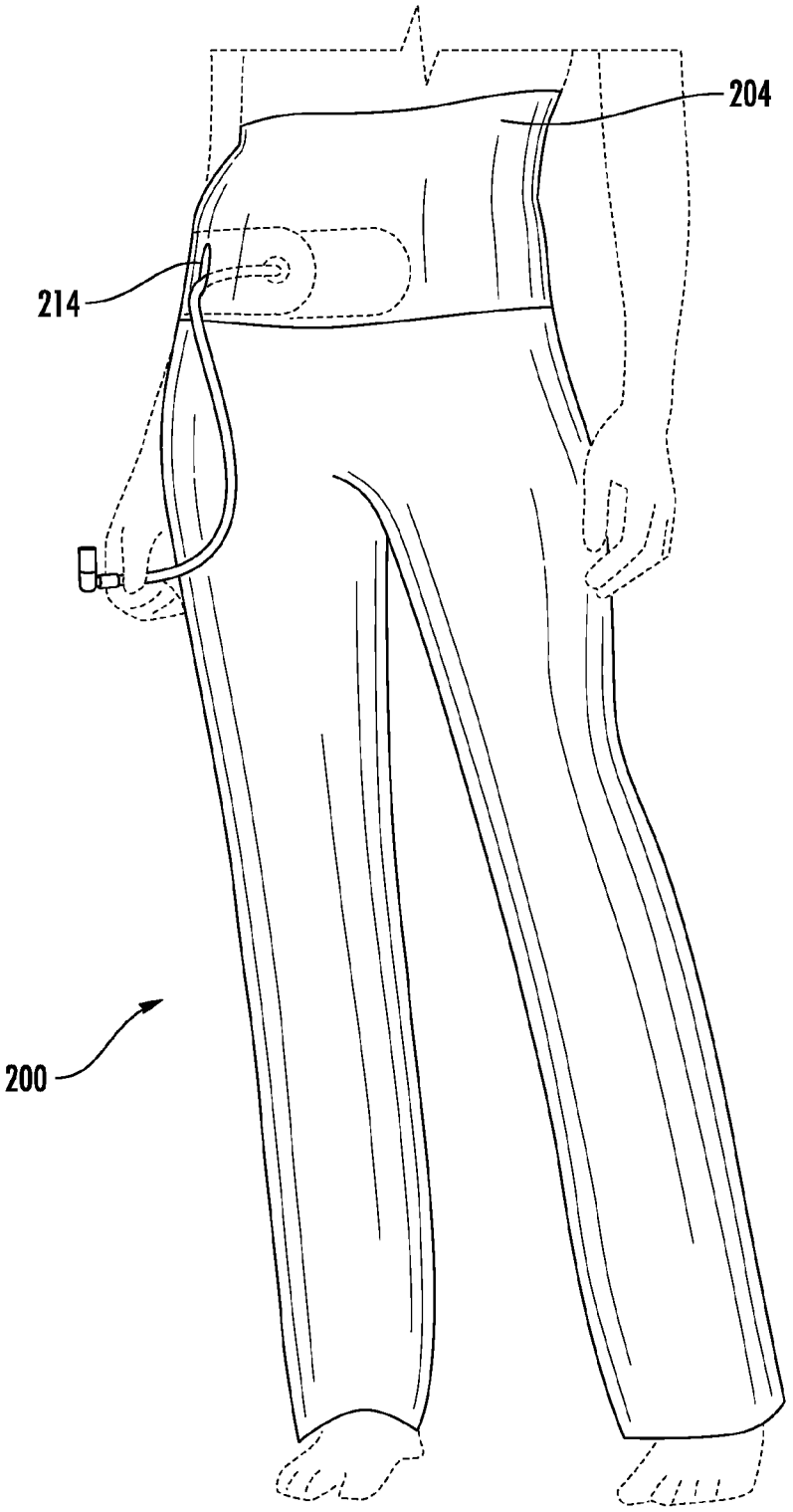

Referring now to FIGS. 2A and 2B, there is shown a STRAIGHT LEG version of an activewear garment 200 comprising a waistband pocket of the invention. Similar to other embodiments, garment 200 comprises a body portion 202 with a STRAIGHT LEG configuration terminating in leg apertures 212. In this embodiment, the waistband 204 is about 4 inches in width to accommodate an annular pocket of about 2 inches in width. At aperture 210, in this embodiment, the upper portion of the waistband 204, which upper portion is also about 2 inches in width, is folded down (FIG. 2A) to hide the pocket slit and extended (FIG. 2B) to show a vertical pocket slit 214. As shown in FIG. 2B, there is no horizontal seam dividing the waistband 204 into smaller sections, thus, the waistband pocket in this embodiment is the total width of waistband 204, or 4 inches. These larger compartments are useful for stowing and carrying personal items such as a bladder for holding water for the wearer of garment 200 to be able to drink while on the go. As shown, the bladder can be inserted into the waistband of the garment 200 through opening 214 and held in place by the elasticity of the waistband fabric alone or in combination with the opening being smaller than the bladder. Access to the water or other drink contained in the bladder can be provided by a tube connected with the bladder and which is conveniently disposed through opening 214 in a manner such that the user can drink from the tube or straw when desired. Having the bladder tucked away in the waistband of the pant provides great convenience for the user in not having to hold a water bottle instead.

Figure 3A:
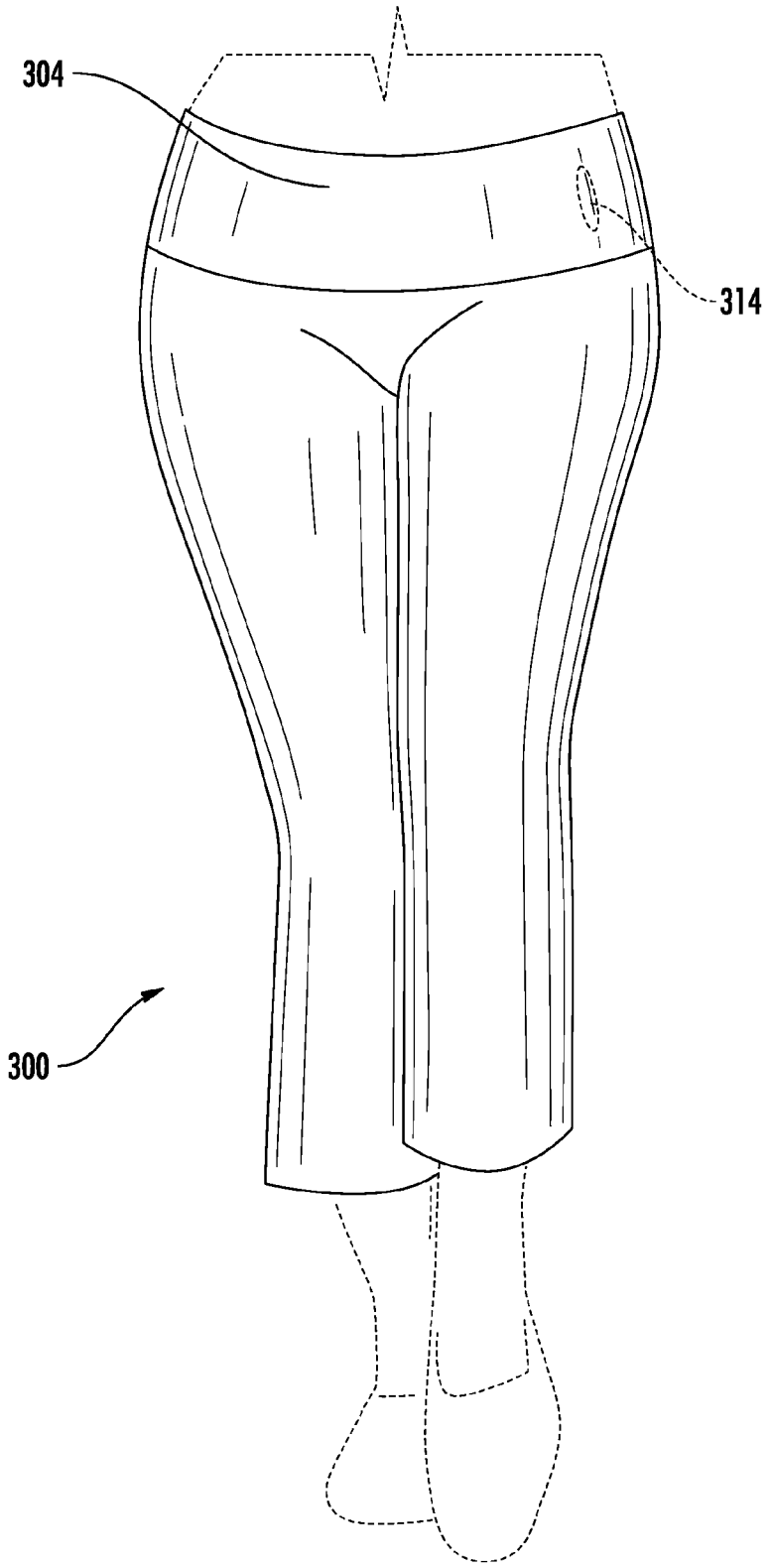
FIGS. 3A-B are schematic diagrams showing a CAPRIS BOOT CUT style pant of the invention comprising a waistband folded down to hide the pocket slit (FIG. 3A) and the waistband unfolded to reveal a vertical pocket slit on the left side of the pant (FIG. 3B).
Figure 3B:
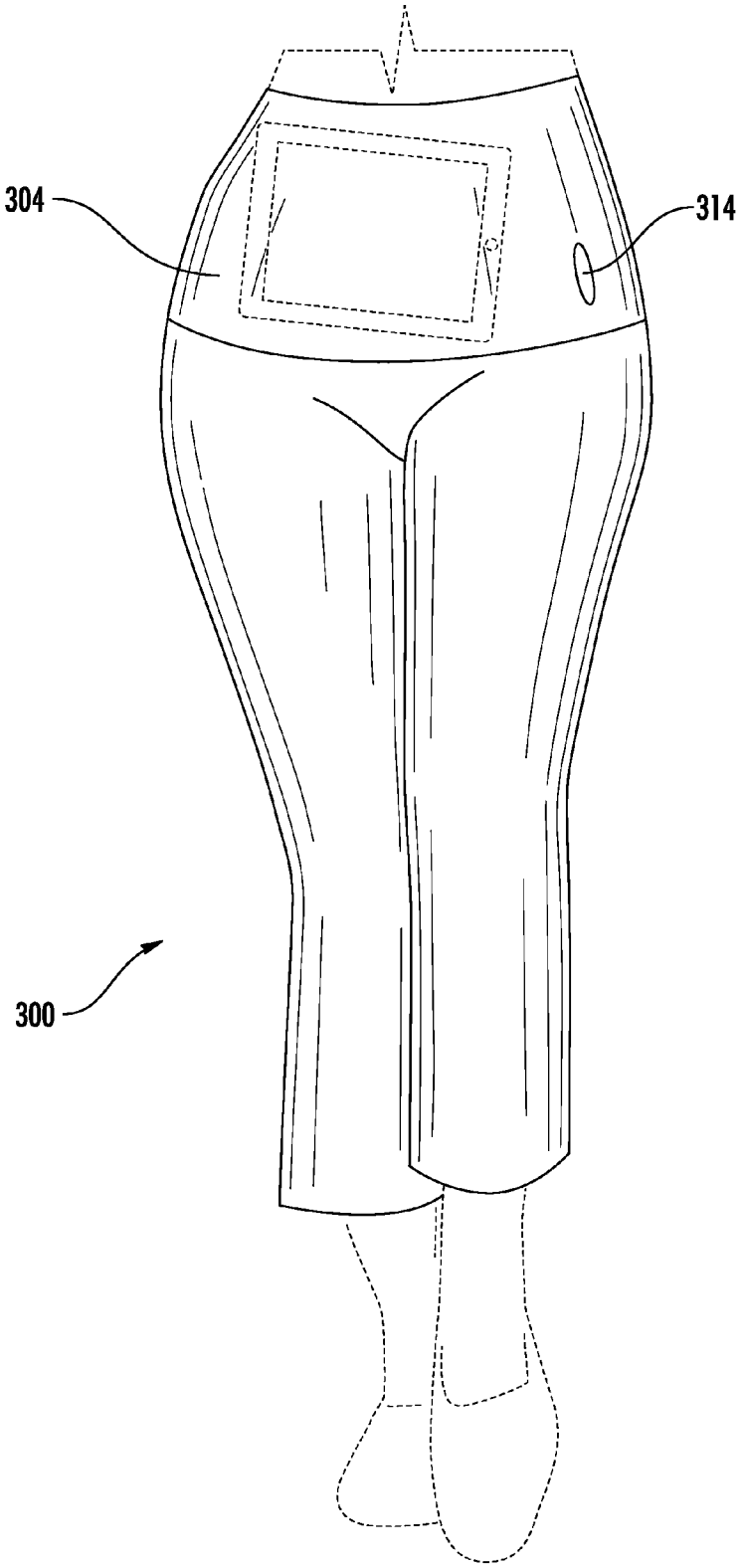

FIGS. 3A and 3B provide for a CAPRIS BOOT CUT leg version of the activewear garment 300 according to another embodiment of the invention. This version comprises a waistband 304 with a waistband pocket. As shown, the waistband 304 is about 3 inches in its folded over state (FIG. 3A) and about 6 inches when unfolded (FIG. 3B). There is no horizontal seam in the waistband 304 so the entire width of the waistband is available as a pocket. As shown, with a compartment of about 6 inches wide, the pocket is able to accommodate even larger items such as a tablet computer. During use, the tablet computer can be inserted into the pocket using openings 314, which are shaped, sized, and otherwise configured to allow for a tablet computer to be inserted into the garment 300 but also provide for retaining the tablet during use of the garment.

Figure 4A:
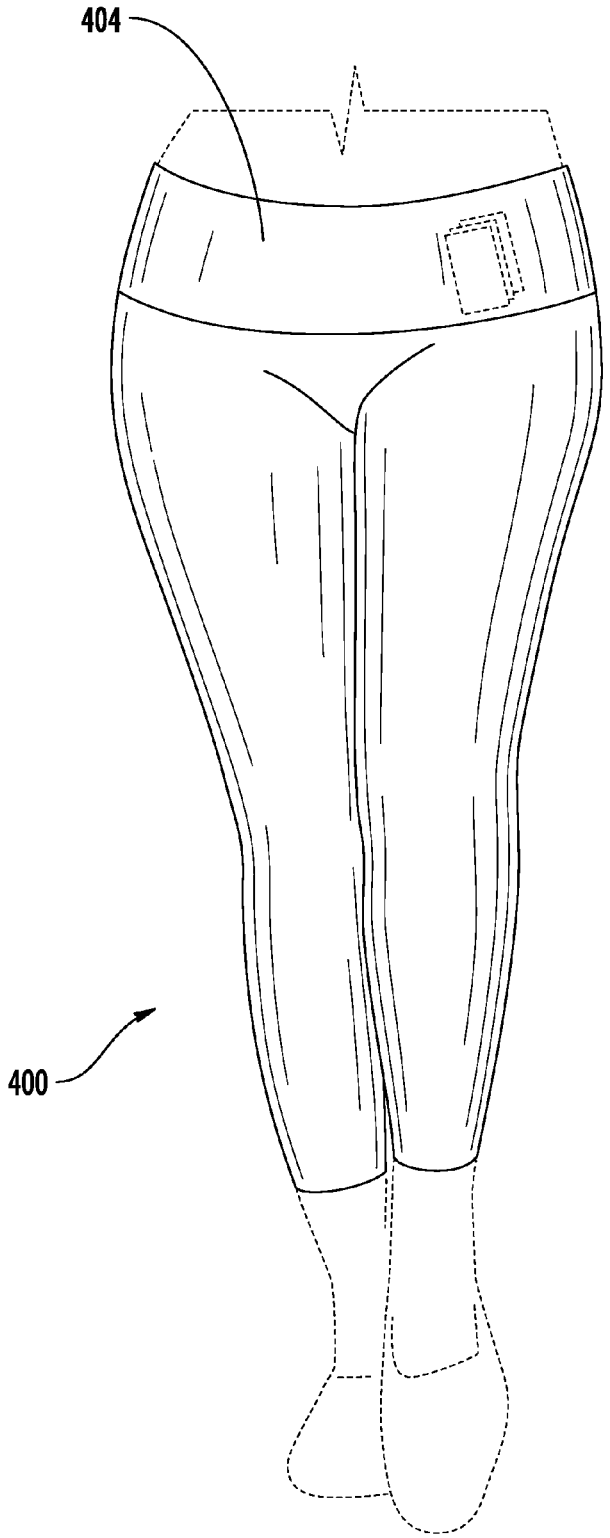
FIGS. 4A-B are schematic diagrams showing a CAPRIS STRAIGHT LEG style activewear embodiment of the invention comprising a waistband folded down to hide the pocket slit (FIG. 4A) and the waistband unfolded to reveal a vertical pocket slit on the left side of the pant (FIG. 4B).
Figure 4B:
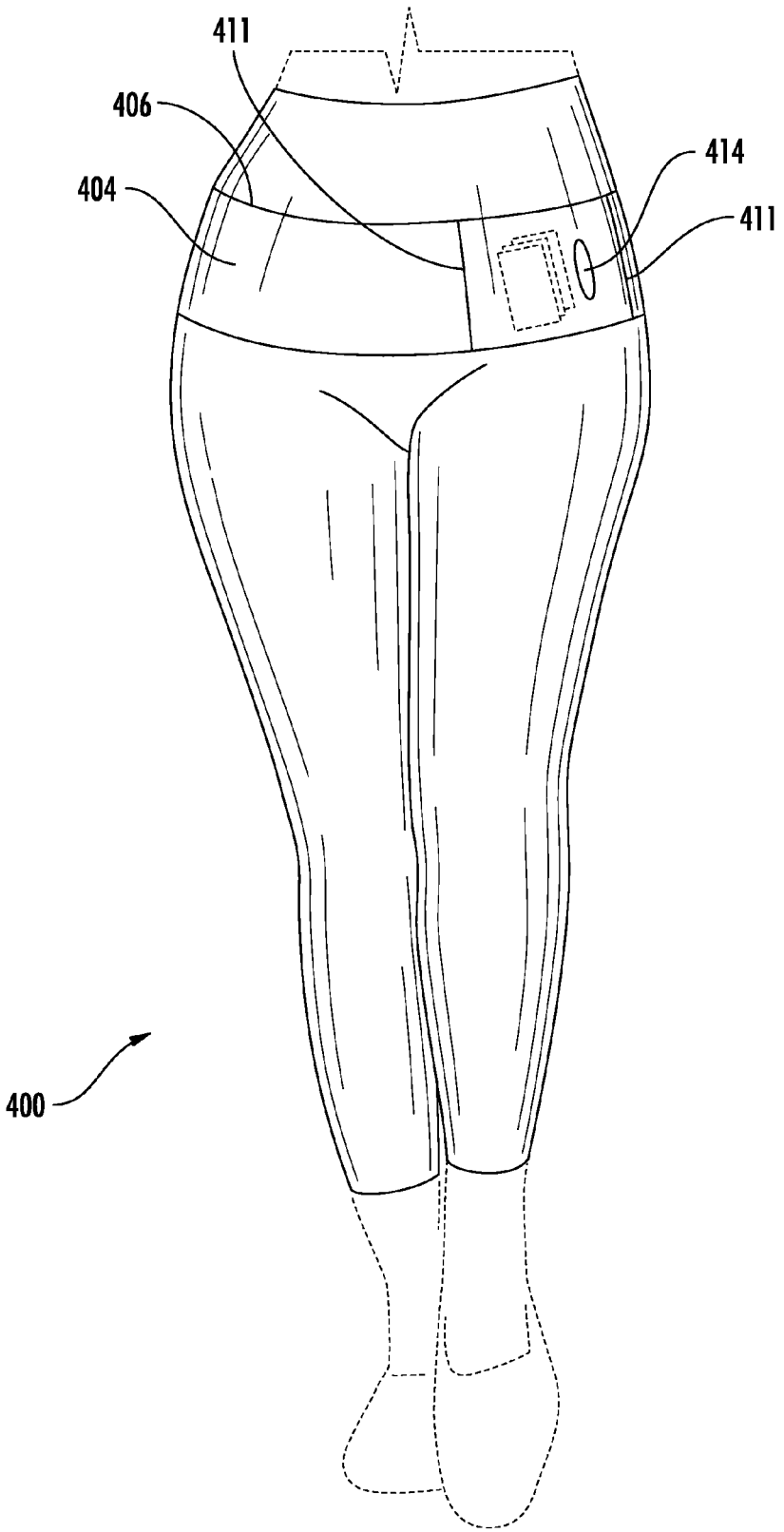

FIGS. 4A and 4B show a CAPRIS STRAIGHT LEG version of an embodiment of the invention which is an activewear garment 400. This embodiment has a 5 inch waistband where 2.5 inches can be folded over (FIG. 4A) to conceal the pocket opening, or unfolded (FIG. 4B) to reveal the opening, such as for inserting items into the waistband pocket. As shown, personal items such as business cards can be held safely and securely within the pocket. In this embodiment, the waistband 404 is divided by a horizontal seam 406 to provide a pocket that comprises only the lower half of the waistband 404. In addition, two vertical seams 411 are provided one on each side of pocket opening 414. The vertical seams 411 can be any number, can be disposed at any location around the waistband 404, can be oriented in any direction, can be any shape or size, and can be provided to such that a desired pocket size and shape is incorporated into the waistband 404. In this embodiment, business cards are placed in and retained within the waistband pocket. The smaller segregated pocket provides for the business cards to stay put once inserted into the waistband instead or migrating around the waistband as perhaps might happen with a larger pocket.

Figure 5A:
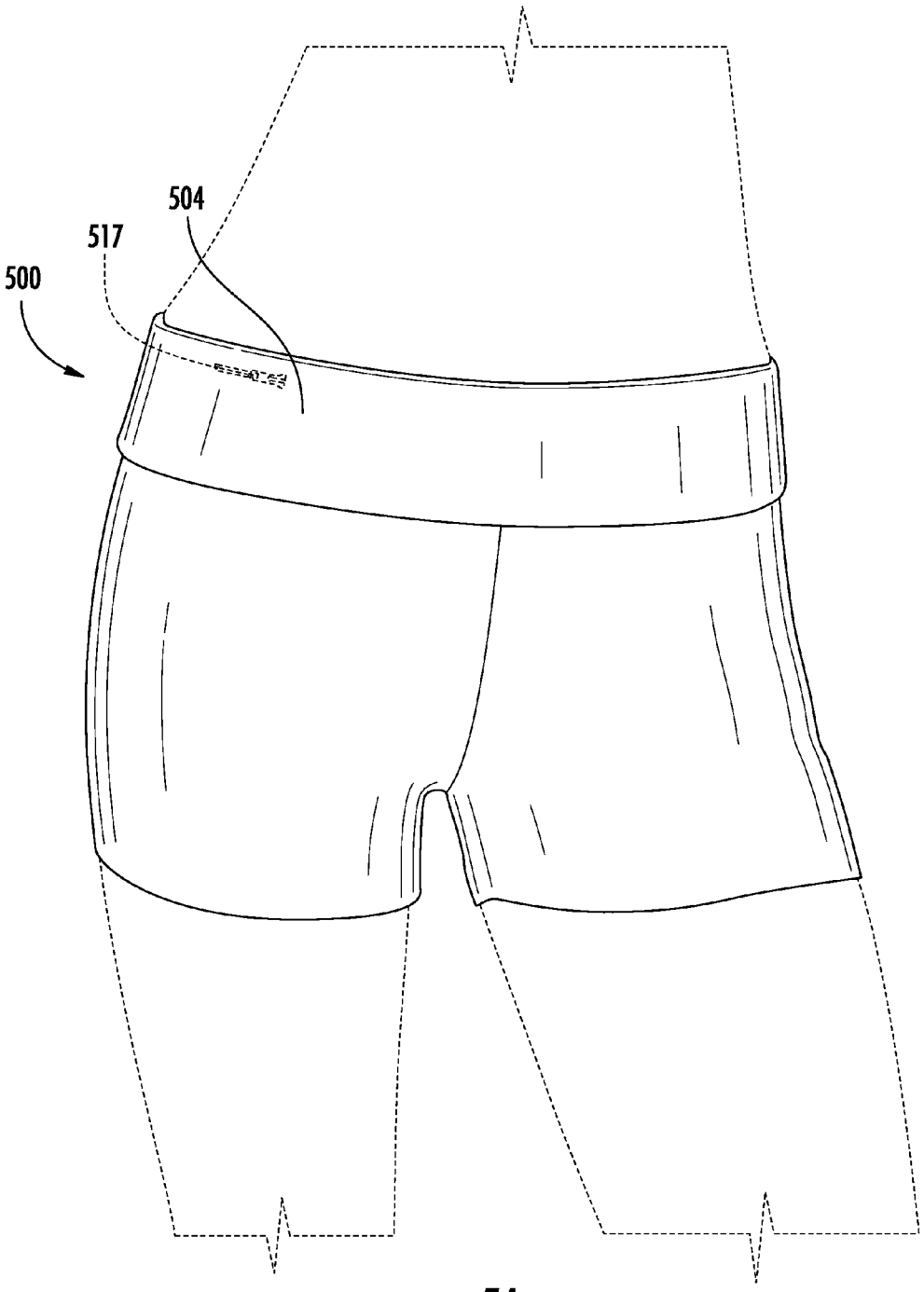
FIGS. 5A-B are schematic diagrams showing a FORM FITTING RUNNING SHORT style activewear embodiment of the invention comprising a waistband folded down to hide the pocket slit (FIG. 5A) and the waistband unfolded to reveal a horizontal pocket slit on the right side of the pant (FIG. 5B).
Figure 5B:
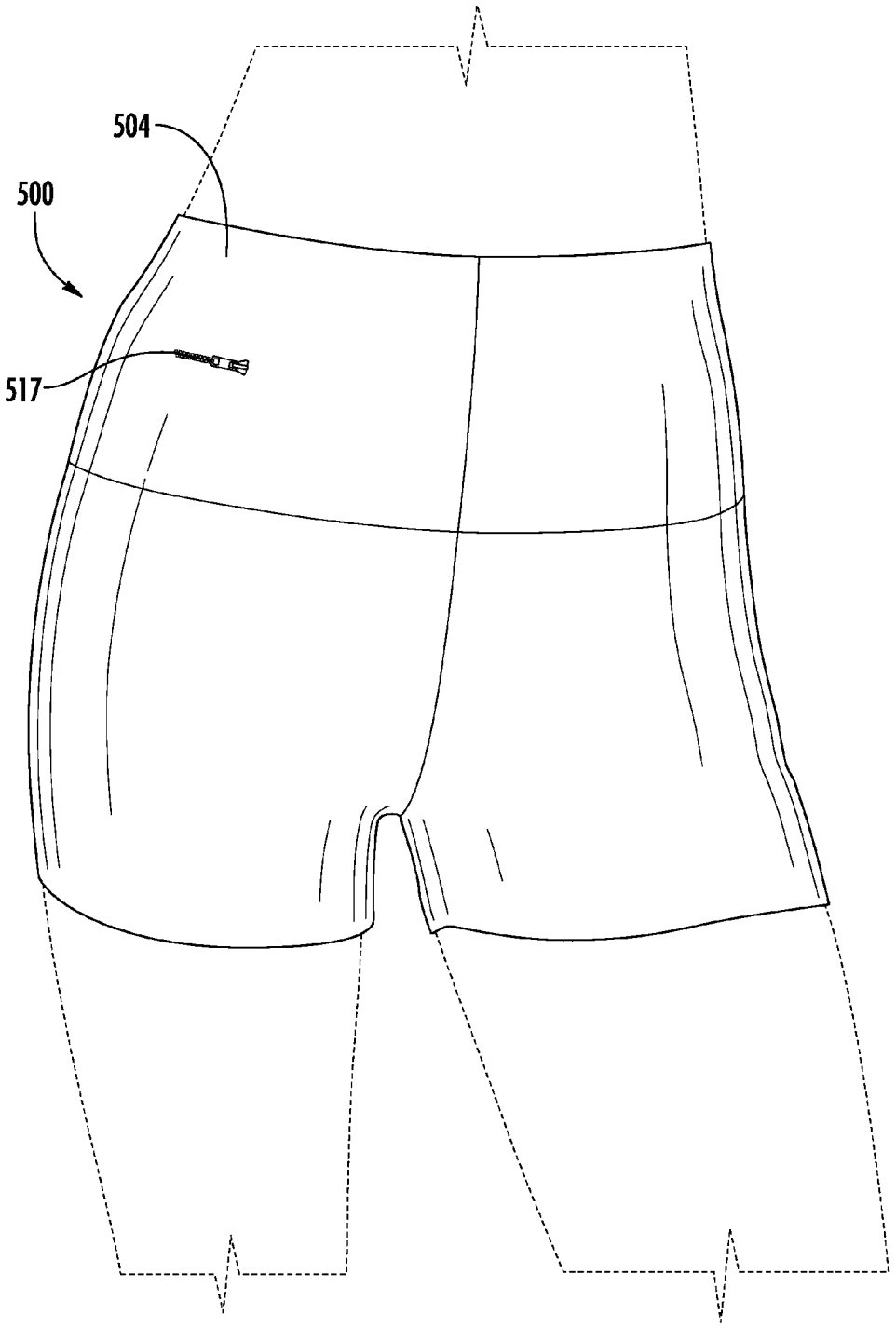

FIGS. 5A and 5B provide a TIGHT SHORT version of the garment 500 comprising a waistband pocket. This embodiment has a 4 inch waistband 504 folded down to a width of about 2 inches to hide the pocket opening (FIG. 5A), which can also be unfolded (FIG. 5B) to show a horizontal 517 zippered opening for accessing the pocket. As shown, the pocket opening 517 can comprise any type of closure, with preferred closures including laces, a zipper, button(s), Velcro, or snaps. A flap to cover the opening can also be incorporated into the garment 500, but preferred are pocket openings with no additional fabric, such as a pocket flap.

Figure 6A:
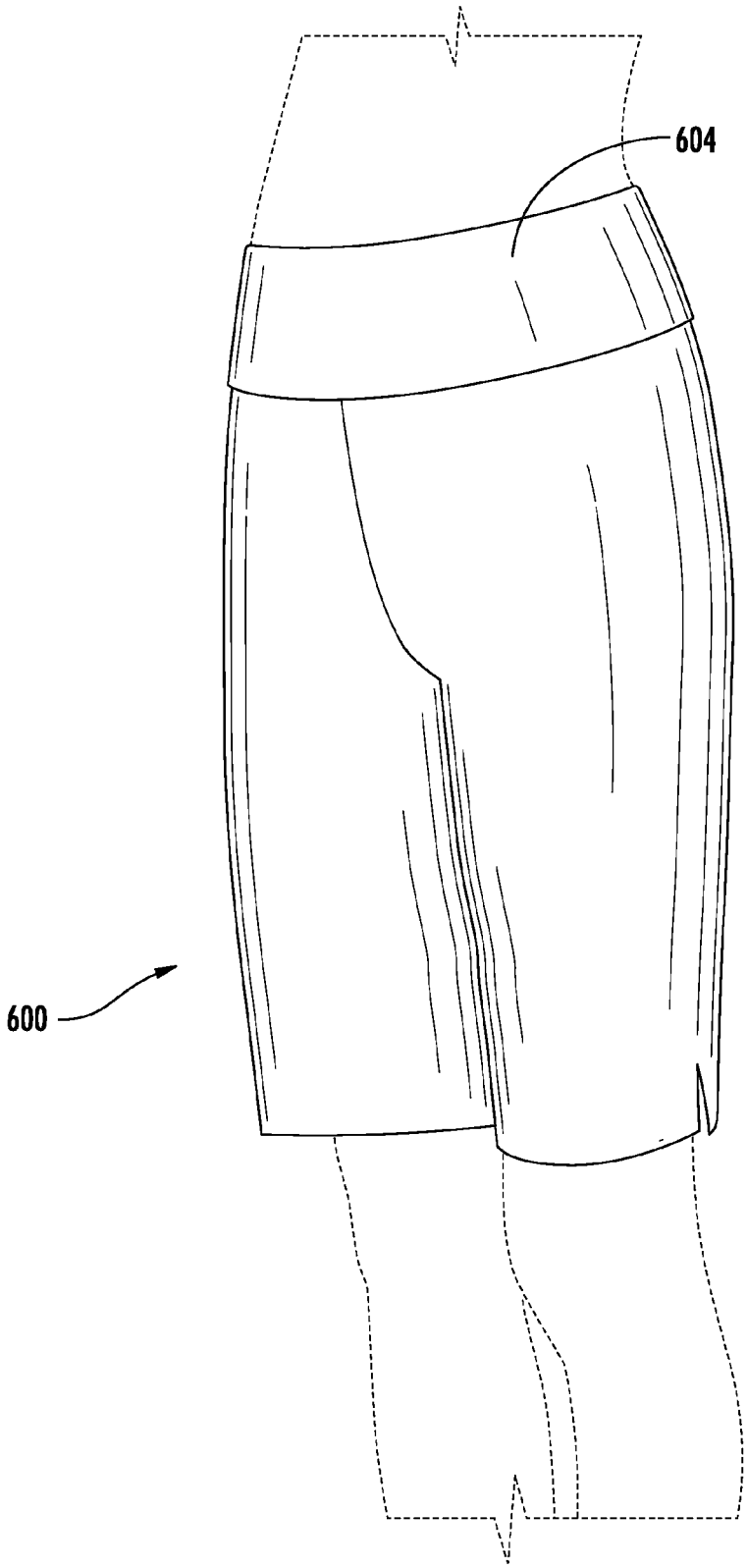
FIGS. 6A-B are schematic diagrams of a LOOSE SHORT embodiment of the invention comprising a waistband folded down to hide multiple pocket slits (FIG. 6A) and the waistband unfolded to reveal pocket slits on the left and right sides of the short (FIG. 6B).
Figure 6B:
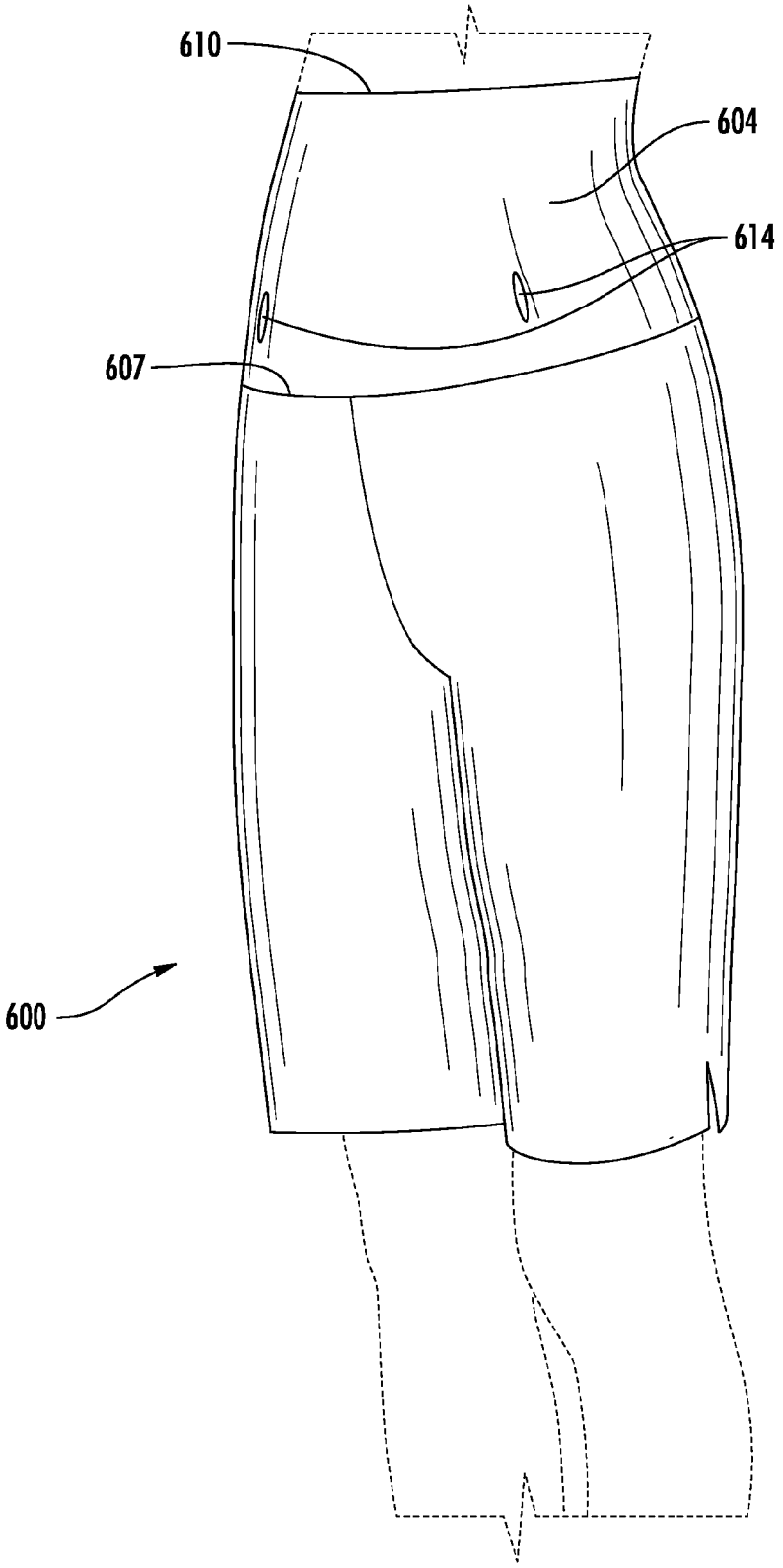

FIGS. 6A and 6B show a LOOSE SHORT version of activewear garments 600 according to embodiments of the invention. This activewear garment 600 comprises a 5 inch waistband 604, which can be folded down (FIG. 6A) to hide the pocket opening(s) or can be extended (FIG. 6B) to an open state to expose vertical pocket openings 614 on both the right and the left side of the waistband 604. Here, the height of the openings is about 5-25% of the height of the entire waistband (i.e., a vertical distance from torso opening 610 to seam 607). In embodiments, the height of the pocket openings 614 can be any height ranging from above 0% to just below 100% of the height of waistband 604, such as about 8-20%, or from about 10-18%.

Figure 7A:
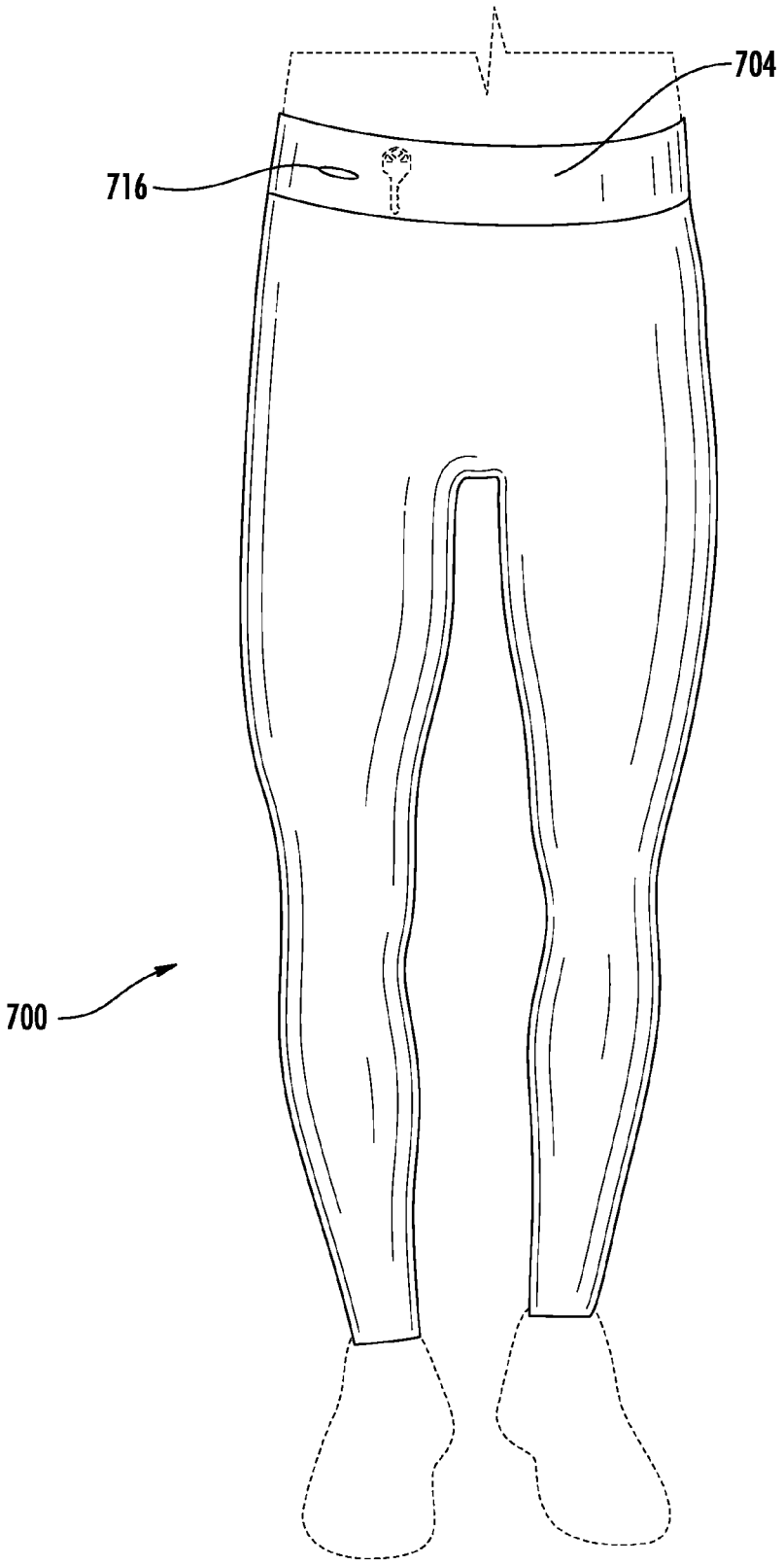
FIGS. 7A-D are schematic diagrams of a MEN'S RUNNING TIGHT style pant of the invention with an annular waistband pocket comprising a horizontal pocket opening on the right side (FIG. 7A); a horizontal pocket opening on the left side (FIG. 7B); different sized vertical pocket openings on the left and right sides (FIG. 7C); and finished pocket openings on the left and right sides of the pants (FIG. 7D) including a cross-sectional view of a pocket opening (FIG. 7E).
Figure 7B:
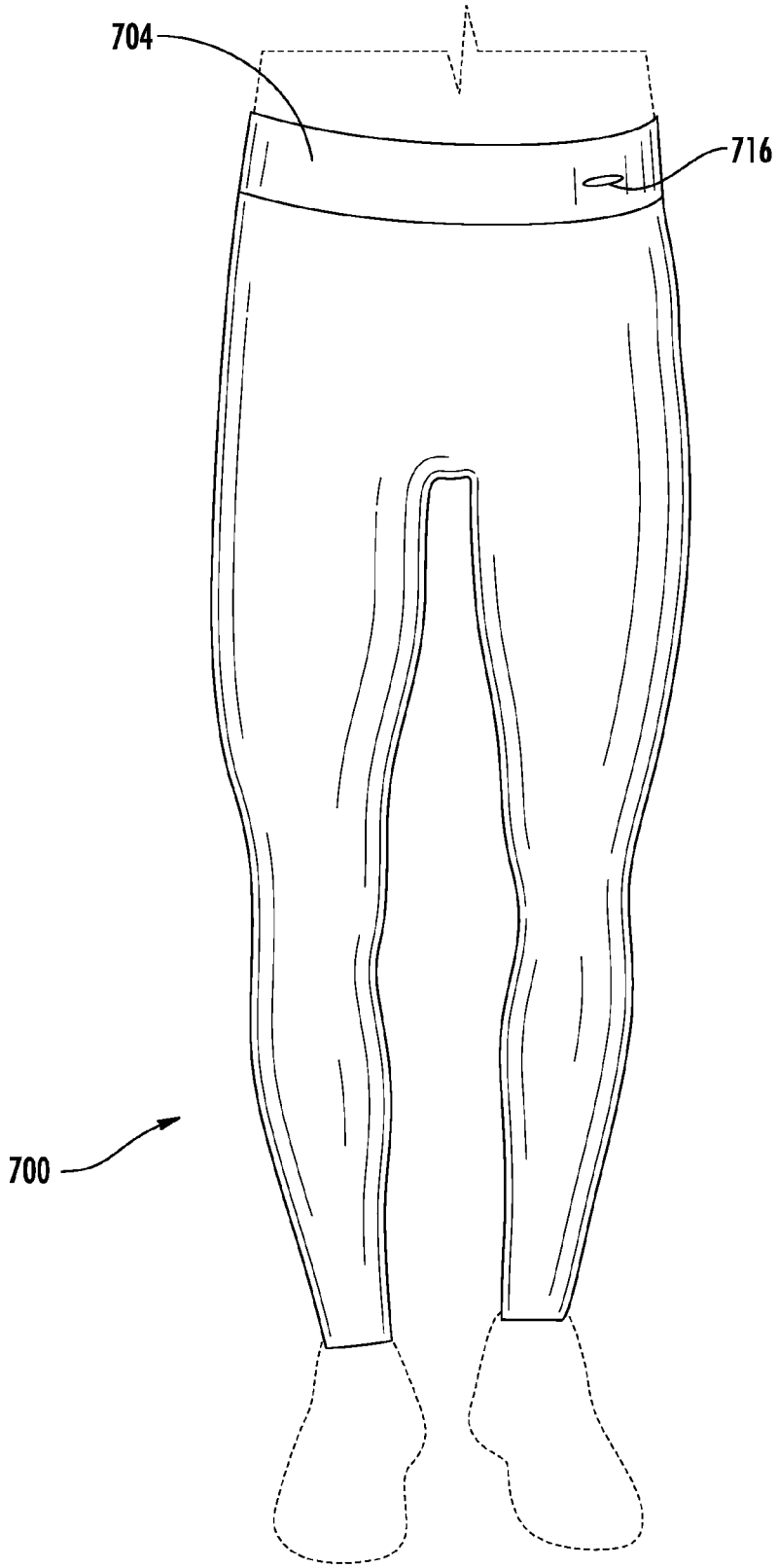
Figure 7C:
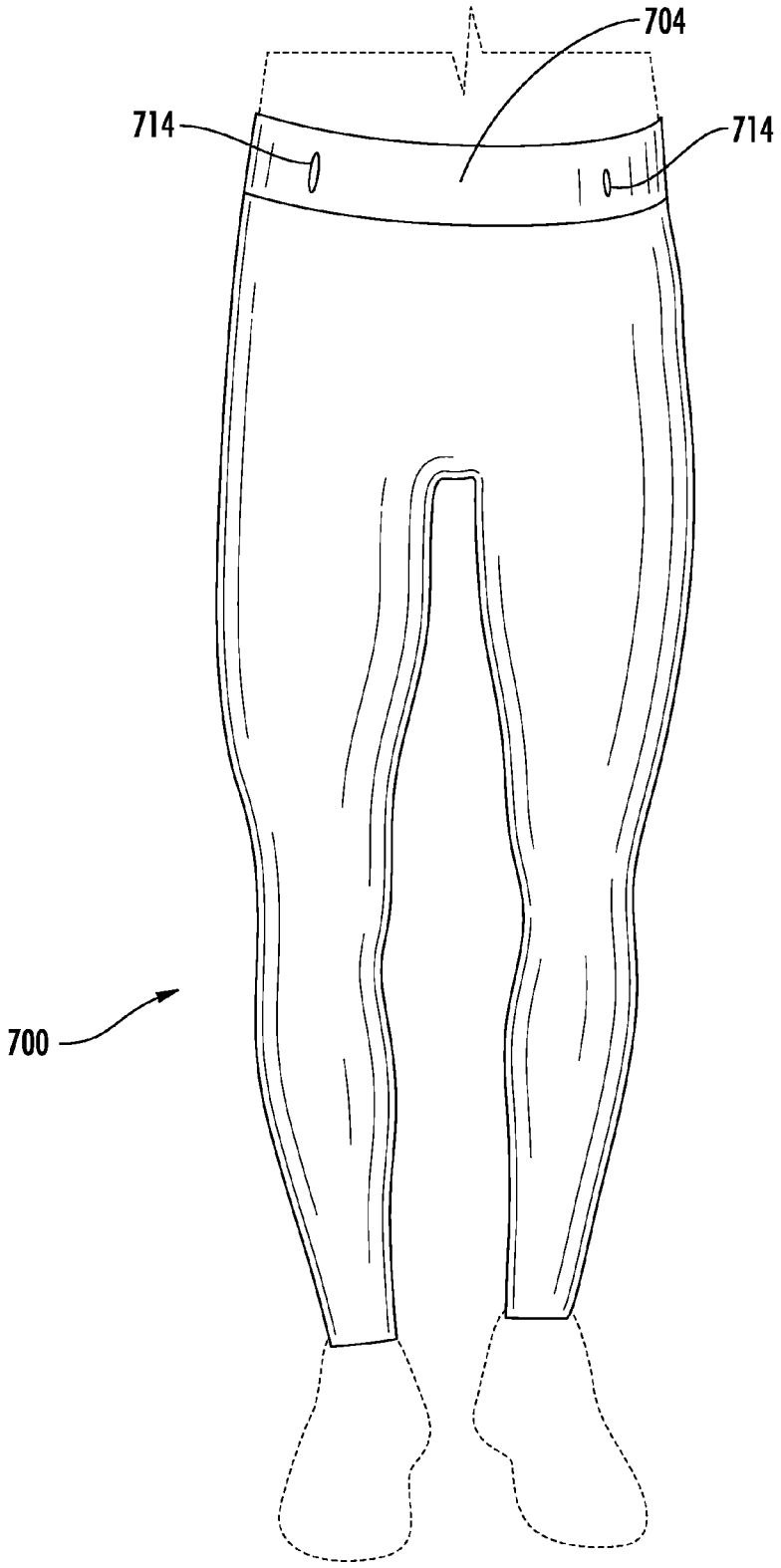
Figure 7D:
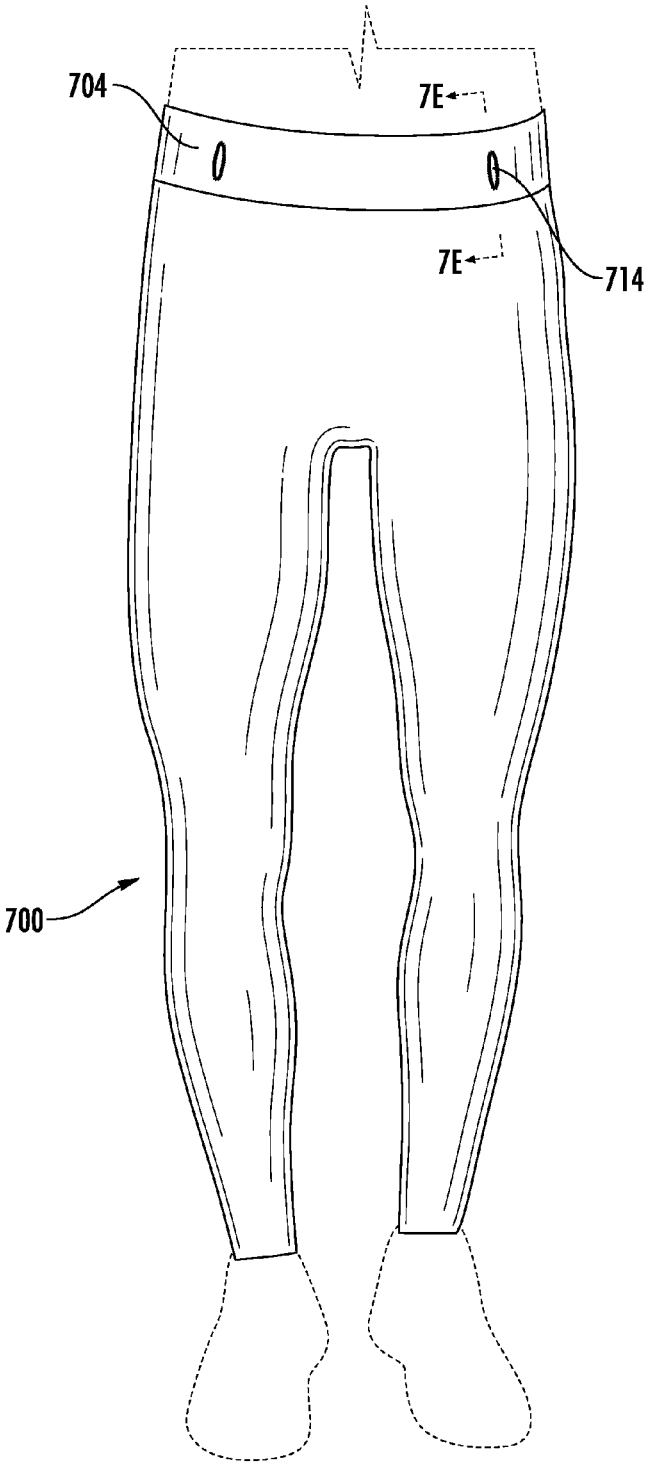

Activewear of embodiments of the invention can include garments for men. FIGS. 7A-D illustrate representative activewear for men that includes a STRAIGHT LEG version of garment 700. This straight leg RUNNING PANT style comprises a waistband 704 with a waistband pocket for holding personal items such as keys as shown. A horizontal slit 716 type opening is provided for access to the pocket interior. This embodiment comprises a 2 inch waistband 704. The waistband can be folded over, however, to most users of this style pant it is not intended to fold the waistband over. Accordingly, the pocket opening 716 is exposed. As shown in FIG. 7A, the pocket opening 716 can be a horizontal opening and can be left open with an unfinished opening, or the pocket access can be open with a finished opening, or a closure can be included to open and close the pocket access as desired. As demonstrated in FIGS. 7A-B, the pocket opening 716 can be on the left or right side of the pant. As demonstrated in FIG. 7C, different sized vertical openings 714 can be disposed at any position on the waistband 704. Alternatively, the different sized openings can also be horizontal openings or at least one horizontal opening and at least one vertical opening. Here, one of the openings has a height of between 40-90% of the waistband, while the other opening has a height ranging from about 20-50% of the height of the waistband. Alternatively, openings 714 can be the same size as shown in FIG. 7D. The openings 714, 716 can be finished or unfinished. As shown in the cross-sectional view FIG. 7E of the pocket, the openings 714 are preferably finished, button-hole type openings. The pocket can be annular in that it encircles the entire waistband 704 of the pant, or can be any size less than that length.

Figure 7E:
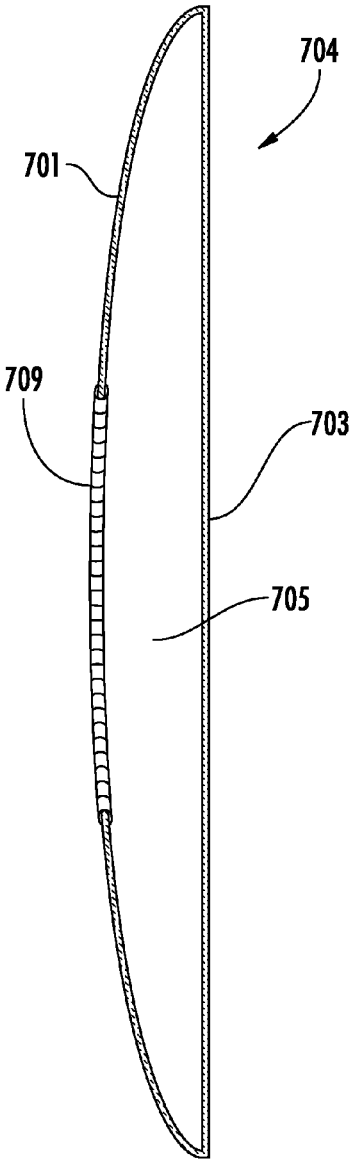

FIG. 7E provides additional detail about the pocket of waistband 704. More particularly, a cross-sectional view of the pocket is provided, which shows a cross section of the annular region defined by the pocket. As illustrated, pocket 705 can be formed from a single sheet of material folded over to provide for space between the folded sheet. The folded sheet comprises a front layer of material 701 and a back layer of material 703. When a garment containing the waistband pocket 705 is worn by a wearer in a typical manner, the back layer of material 703 is in contact with the waist of the wearer, while the front layer of material 701 will face outward and be seen by others. The finished opening 709 to the pocket 705 can be incorporated into the fabric at any point but is preferably introduced prior to partial formation of the waistband, or prior to complete formation of the waistband. For example, the finished openings 709 can be added to the sheet of fabric in a similar manner to button holes. Then the material can be joined at the elongated ends of the fabric to provide the sheet of fabric as a ring of material. The ring-like sheet of material can then be folded over on itself and sewn around the bottom elongated edges of the front 701 and back 703 layers to join the material and create an annular or tubular region between layers 701, 703. Alternatively or in addition, once the sheet of material is folded over, the sheet of material can be joined with the body portion of the garment along the elongated edge of the body portion as well. Sewing or joining these edges (the body portion edge, the front layer 701 edge, and the back layer 703 edge) together simultaneously may save on manufacturing steps and costs.

Figure 8A:
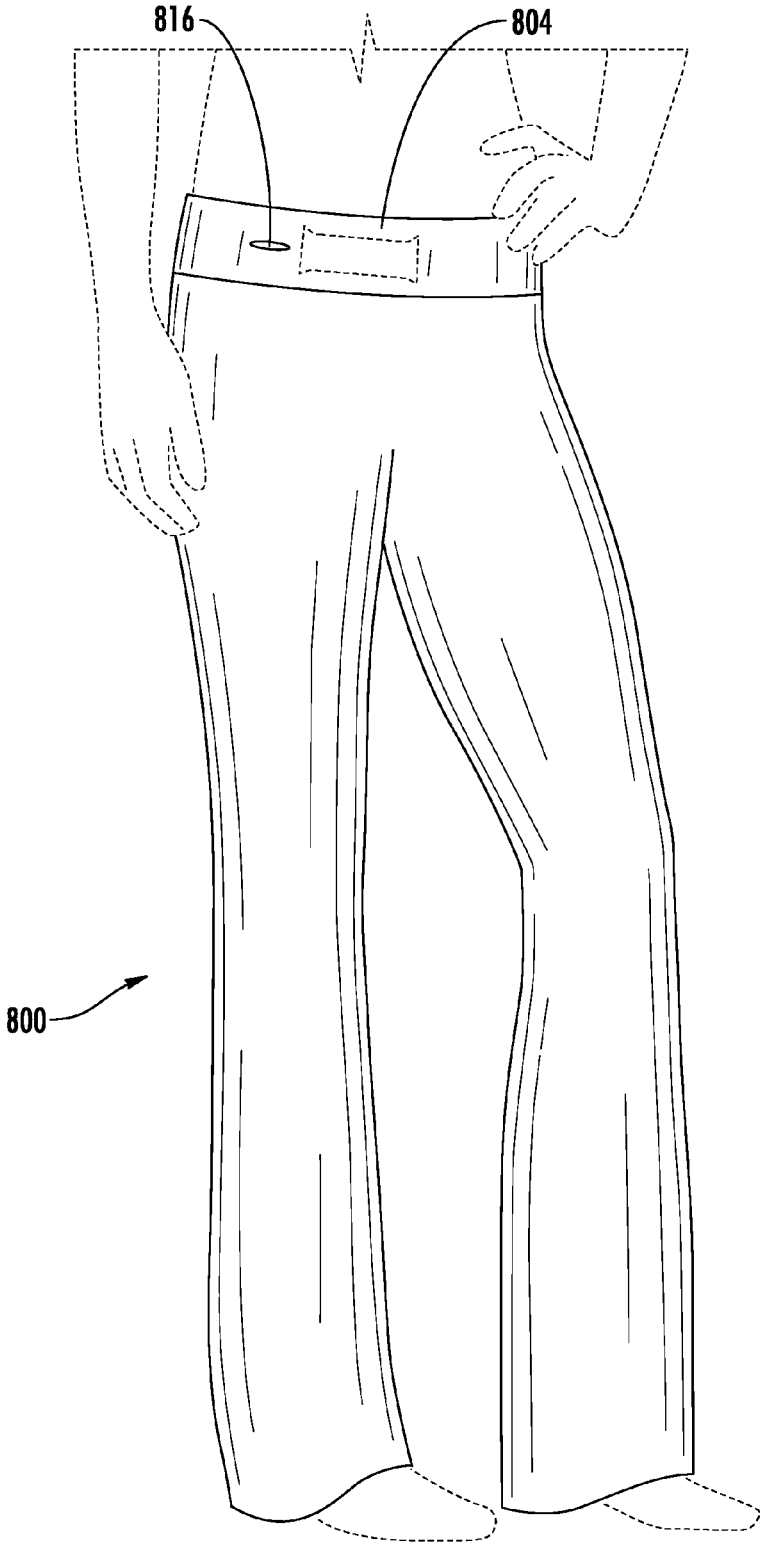
FIGS. 8A-B are schematic diagrams showing a BOOT CUT style activewear embodiment of the invention with a right-side horizontal pocket opening (FIG. 8A); and with a left-side horizontal pocket opening (FIG. 8B).
Figure 8B:
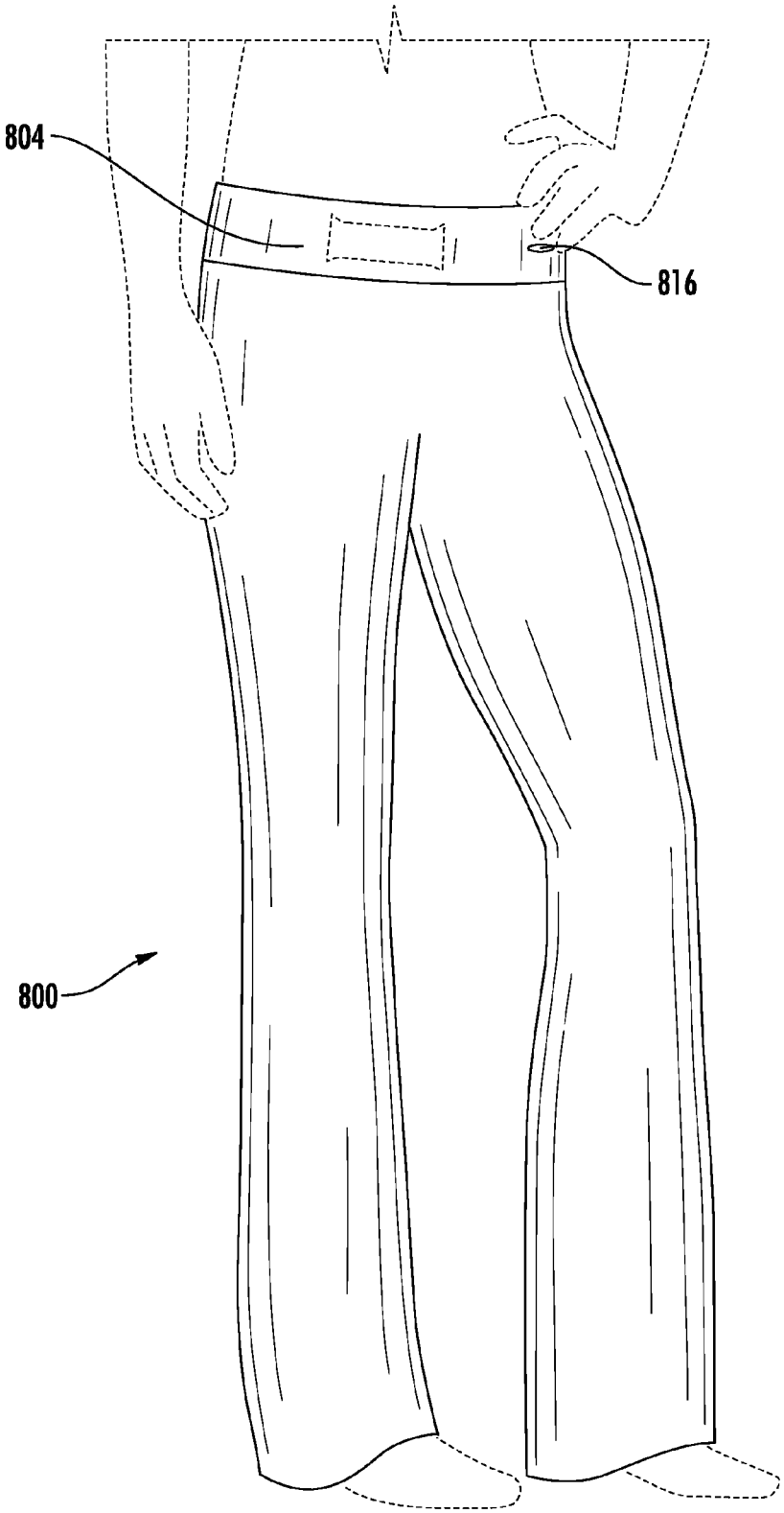

FIGS. 8A-B provide a RUNNING PANT with a BOOT CUT leg embodiment of the activewear according to the invention. As shown, such a pant can comprise a waistband 804 that is intended to remain in an unfolded state on the waist of the user. In such a configuration, the pocket opening 816 to the waistband pocket is exposed and thus visible to others. The horizontal pocket opening 816 in FIG. 8A is shown on the right side of the pant and has a width of about 30-60% of the height of the waistband. The horizontal pocket opening 816 in FIG. 8B is shown on the left side of the pant and has a width of about 10-50% of the height of the waistband. In the context of this specification it is important to note that when referring to the dimensions of the pocket opening either the width or height may be used. When referring to height, the pocket opening is usually disposed in a vertical position and when referring to width of the pocket opening the opening is typically disposed in a horizontal position. In either case, what is intended is referring to the largest dimension of the opening in a relaxed state. Because in preferred embodiments, the opening will be a cut in the fabric, such as a single slit, there will only be one dimension to the opening, which is also the length of the cut.

Figure 9:
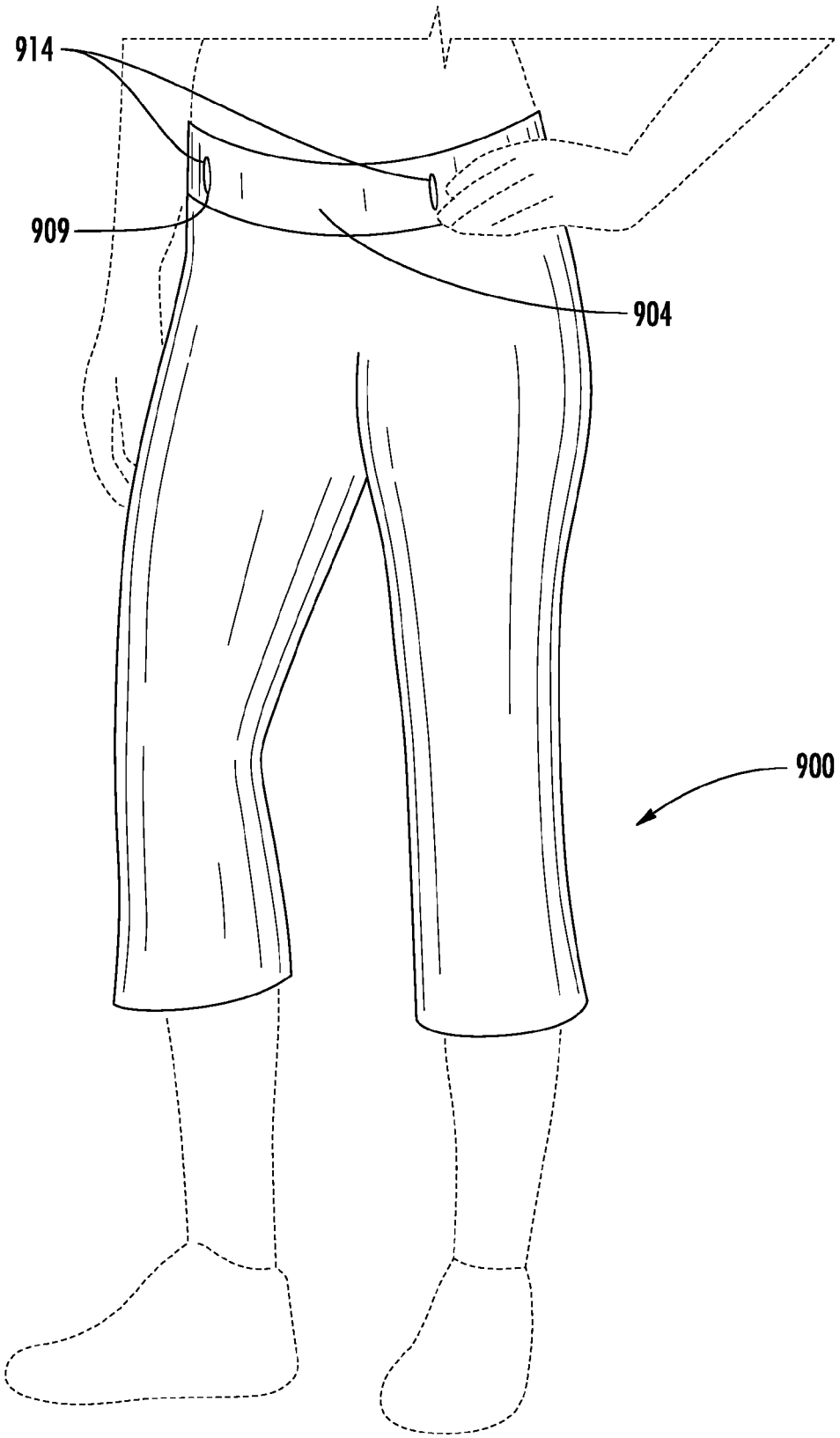
FIG. 9. is a schematic diagram of a CAPRIS BOOT CUT style pant of the invention showing multiple vertical pocket openings for a waistband pocket.

FIG. 9 is yet another activewear embodiment 900 of the present invention. This embodiment provides for a CAPRIS BOOT CUT style with a waistband pocket. Two vertical pocket openings 914 are provided for access to the pocket. One of the pocket openings 914 has an unfinished edge and the other opening has a finished edge 909. Any number of finished or unfinished edge openings 914 can be used. The waistband 904 in this configuration is about 1.5 inches wide/high, while the openings 914 are about 0.75-1.5 inches wide/high.

Figure 10:
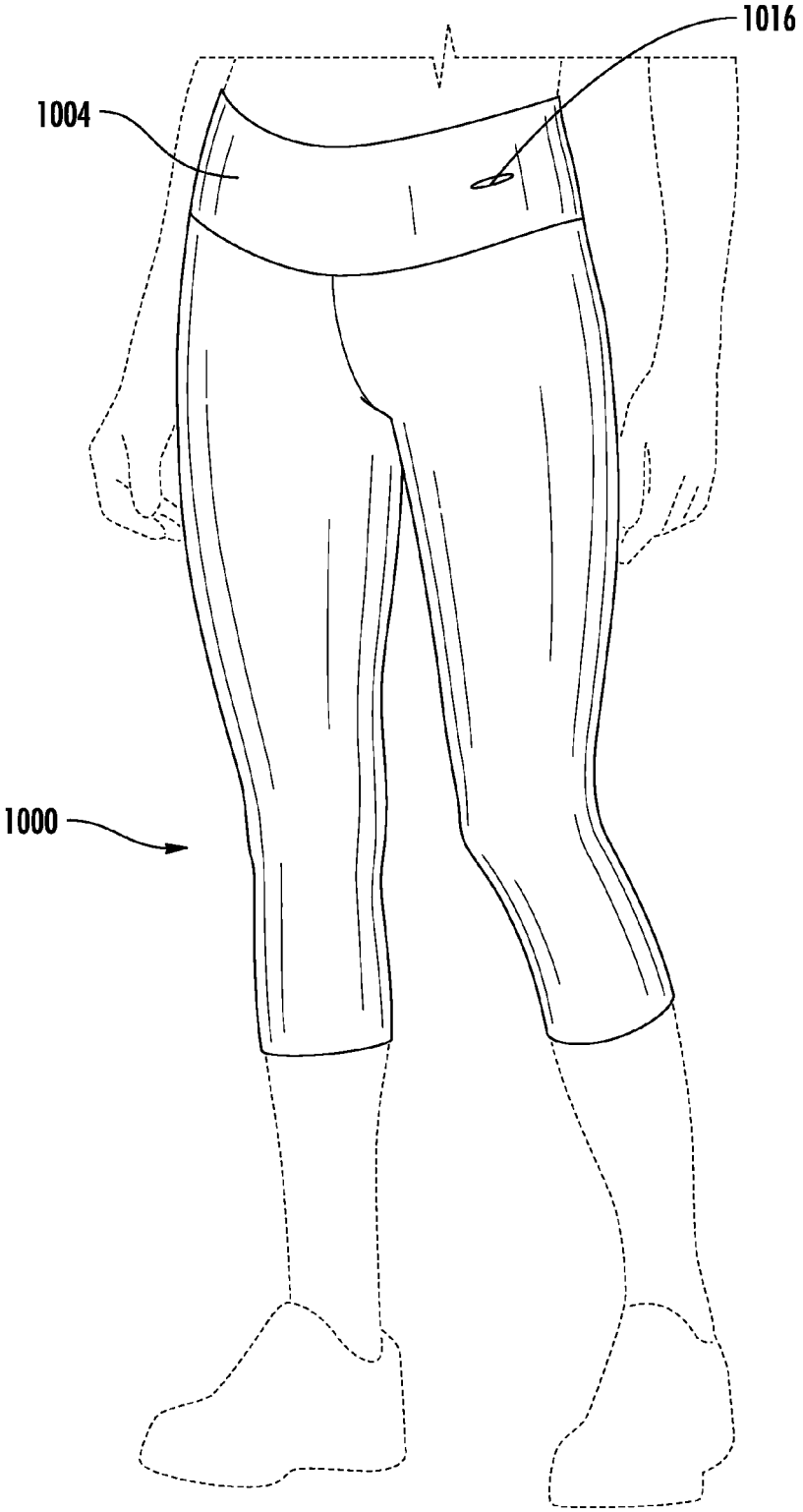
FIG. 10. is a schematic diagram of a CAPRIS STRAIGHT LEG style pant embodiment of the invention showing a waistband pocket with a left-side horizontal opening.
Figure 11:
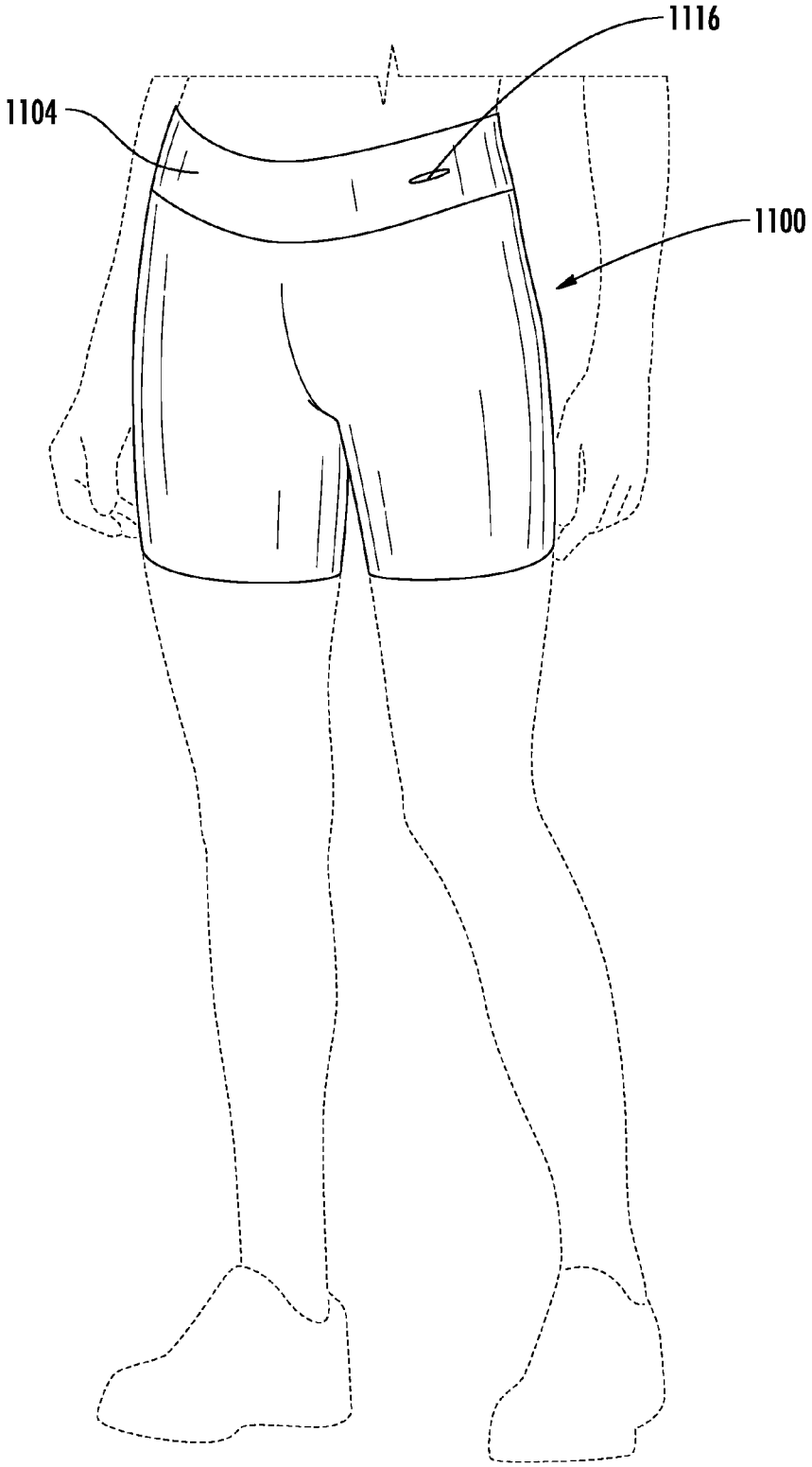
FIG. 11. is a schematic diagram of a FORM FITTING SHORT embodiment of the invention showing a waistband pocket with a left-side horizontal opening.
Figure 12:
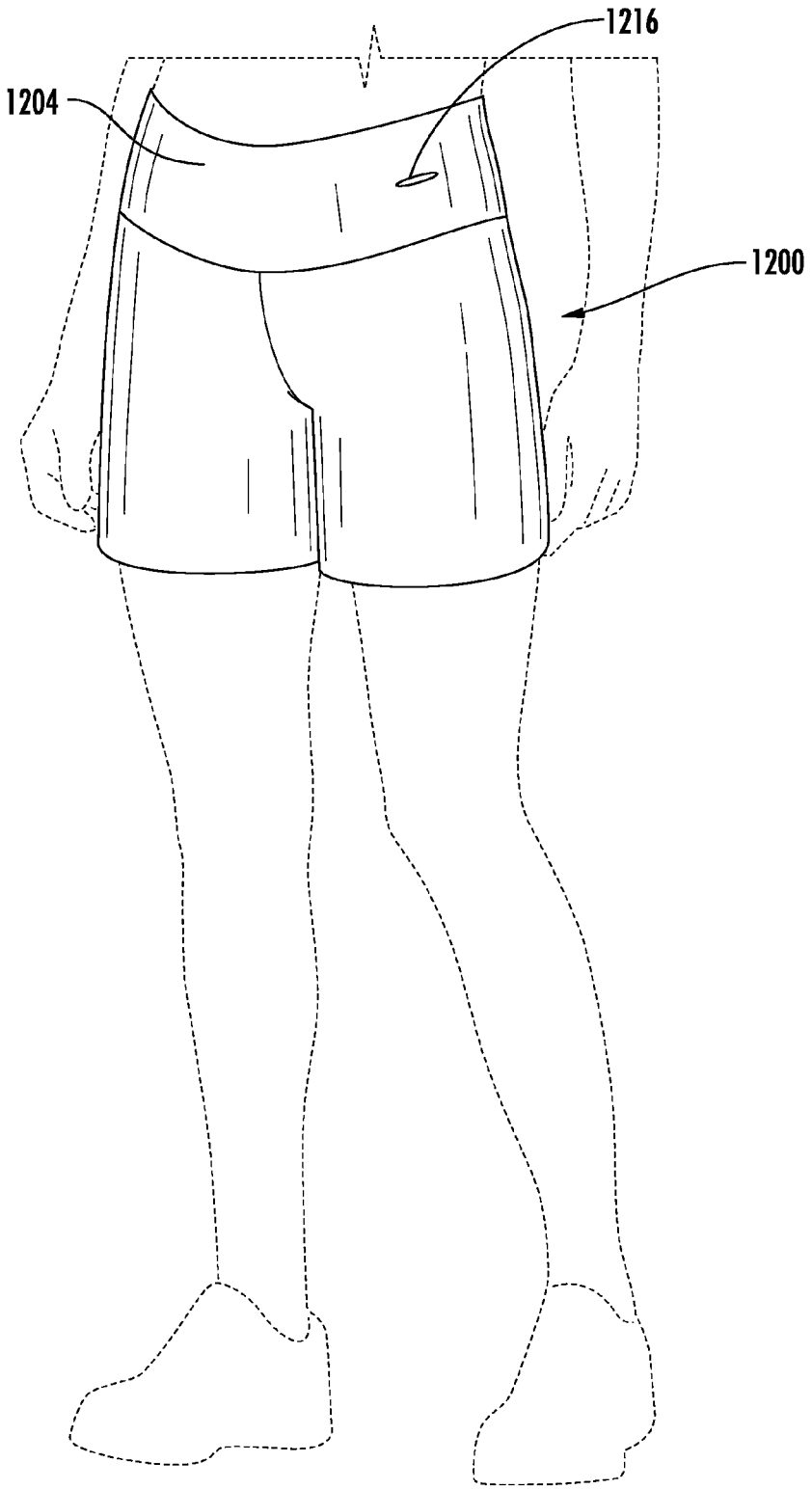
FIG. 12. is a schematic diagram of LOOSE SHORT style garment with a waistband pocket having a left-side horizontal opening.

FIG. 10. is a schematic diagram of a CAPRIS STRAIGHT LEG style pant 1000 embodiment of the invention showing a waistband pocket with a left-side horizontal opening. The waistband 1004 with left side 1-inch horizontal 1016 pocket slit is disposed within a 3-inch waistband 1004. FIG. 11. is a schematic diagram of a FORM FITTING SHORT 1100 embodiment of the invention showing a waistband 1104 with a waistband pocket having a left-side horizontal opening 1116. This pant comprises a 2-inch waistband with a 1-inch slit. FIG. 12. is a schematic diagram of a LOOSE SHORT 1200 style garment with a waistband pocket having a left-side horizontal opening 1216. As shown in FIG. 12, a 3-inch waistband 1204 comprises a 1-inch horizontal 1216 pocket slit. Although the various embodiments illustrated in this specification provide for a wide range of alternatives for the activewear inventive embodiments, other configurations and styles are also possible, such as for example, any garment having a waistband, including additionally shirts, skirts, and skorts.

One of the many potential advantages of the present invention, only some of which are discussed in this specification, includes that the present invention provides a comfortable and secure way to carry items while exercising or moving from place to place (i.e., on the go), which does not restrict the user's range of motion. Another advantage of the present invention is to provide security of personal items from loss or theft while exercising by being able to contain the items on the person. Yet another advantage of the present invention includes easy access to the items in the concealed pocket within the activewear.

The present invention has been described with reference to particular embodiments having various features. It will be apparent to those skilled in the art that various modifications and variations can be made in the practice of the present invention without departing from the scope or spirit of the invention. One skilled in the art will recognize that these features may be used singularly or in any combination based on the requirements and specifications of a given application or design. Other embodiments of the invention will be apparent to those skilled in the art from consideration of the specification and practice of the invention in particular by combining the specified features of one embodiment with one or more features of another embodiment. It is intended that the specification and examples be considered as exemplary in nature and that variations that do not depart from the essence of the invention are intended to be within the scope of the invention.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown. It is therefore evident that the particular illustrative embodiments disclosed above may be altered or modified and all such variations are considered within the scope and spirit of the present invention. While embodiments are described in terms of "comprising," "containing," or "including" various components or steps, the embodiments can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or "from approximately a to b," or "from approximately a-b") disclosed herein is to be understood to set forth every number and range encompassed within the broader range of values. Also, the terms in the claims have their plain, ordinary meaning unless otherwise explicitly defined. Moreover, the indefinite articles "a" or "an," as used in the claims, are defined herein to mean one, at least one, or more than one of the element that it introduces.

The invention claimed is:

1. Activewear pants comprising:

a body portion made of fabric with two pant legs and an upper edge defining a waistline;

a 360° tubular waistband, with two edges attached together, and made of an elastic material, which is entirely of the same fabric as the body portion;

wherein the upper edge of the body portion is attached to the two edges of the waistband;

wherein the waistband defines an annular pocket capable of holding items; and wherein the annular pocket of the waistband comprises one or more pocket openings disposed in the fabric above the waistline to provide access to the pocket.

2. The activewear pants of claim 1, wherein the one or more pocket openings have a dimension of 10-100% of the width of the waistband.

3. The activewear pants of claim 1, wherein the one or more pocket openings have no closure and are finished around a pocket opening edge by one or more of a hem line, surging, ribbon sewn over the edge, or bias tape sewn over the edge.

4. The activewear pants of claim 1, wherein the one or more pocket openings have a closure chosen from a zipper, hook and loop type closure, hooks, buttons, or snaps.

5. The activewear pants of claim 1, wherein items disposed in the pocket are held in place by one or more of fabric elasticity or pocket opening size.

6. The activewear pants of claim 1, wherein the body portion is an athletic pant style chosen from running pants, capri pants, tight shorts, or loose shorts.

7. The activewear pants of claim 6, wherein the body portion comprises a leg portion configured as straight, boot cut, loose, or form fitting.

8. The activewear pants of claim 1, wherein the waistband comprises one or more of jersey, knit, cotton, nylon, spandex, rayon, polyester, or combinations thereof.

9. The activewear pants of claim 8, wherein the fabric of the body portion and the fabric of the waistband comprise polyester.

10. The activewear pants of claim 1, wherein the pocket openings are disposed from 5-90 degrees relative to an edge of the waistband.

11. The activewear pants of claim 1, wherein the one or more pocket openings have a dimension of 50-100% of the width of the waistband.

12. The activewear pants of claim 11, wherein the one or more pocket openings have a dimension shaped and sized to accommodate a mobile phone.

13. The activewear pants of claim 1, wherein the waistband comprises two or more vertical seams for dividing the annular pocket into smaller segments.

14. The activewear pants of claim 13, wherein two vertical seams are provided to provide a front waistband pocket and a back waistband pocket.

15. An activewear garment comprising:

a body portion of fabric with an upper edge defining a waistline;

a waistband of elastic fabric extending annularly 360° with two edges attached together such that, by using the fabric of the waistband and without adding fabric for a pocket, the waistband defines one or more annular pockets capable of holding items;

wherein the upper edge of the body portion is attached to the two edges of the waistband along the waistline;

wherein the annular pocket of the waistband comprises one or more pocket openings disposed in the fabric above the waistline to provide access to the pocket.

16. The activewear garment of claim 15, wherein the one or more pocket openings have a dimension of 50-100% of the width of the waistband.

17. The activewear garment of claim 16, wherein the pocket openings are disposed from 5-90 degrees relative to an edge of the waistband.

18. The activewear garment of claim 17, wherein the one or more pocket openings have a dimension shaped and sized to accommodate a mobile phone.

19. The activewear garment of claim 15, wherein the waistband comprises two or more vertical seams which divide the annular pocket into smaller segments.

20. The activewear garment of claim 19, wherein two vertical seams are provided to provide a front waistband pocket and a back waistband pocket.

* * * * *